US005682584A

United States Patent [19]

Hattori et al.

[11] Patent Number: 5,682,584

[45] Date of Patent: Oct. 28, 1997

[54] DEVELOPER MIXING AND TRANSPORTING DEVICE

[75] Inventors: Yoshihiro Hattori, Toyokawa; Yoshinobu Hada, Hoi-Gun; Suguru Hamamichi; Shinichi Yoshimoto, both of Toyokawa, all of Japan

[73] Assignee: Minolta Co., Ltd., Osaka, Japan

[21] Appl. No.: 505,491

[22] Filed: Jul. 21, 1995

[30] Foreign Application Priority Data

| | | | |
|---|---|---|---|
| Jul. 28, 1994 | [JP] | Japan | 6-176552 |
| Jul. 28, 1994 | [JP] | Japan | 6-176606 |
| Aug. 24, 1994 | [JP] | Japan | 6-199478 |

[51] Int. Cl.[6] ..... G03G 15/06

[52] U.S. Cl. ..... 399/255; 399/256; 399/260; 399/263

[58] Field of Search ..... 399/254, 255, 399/256, 260, 263

[56] References Cited

U.S. PATENT DOCUMENTS 5,189,474 2/1993 Miya et al. ..... 355/245

FOREIGN PATENT DOCUMENTS 59-9351 U 1/1984 Japan .

*Primary Examiner*—Nestor R. Ramirez
*Attorney, Agent, or Firm*—Sidley & Austin

[57] ABSTRACT

A developer transporting device for electrophotographic copiers has a pair of walls, a rotating shaft supported between the pair of walls, a first transporting member provided on the rotating shaft, a rotating cylindrical screw concentrically sheathing the rotating shaft and having a second transporting member provided on an exterior surface thereof and apertures provided at both ends thereof, an inflow pipe mounted on one wall of the pair of walls and extending into one end of the cylindrical screw and provided with a developer inflow opening facing an aperture of the cylindrical screw, and an outflow pipe mounted on the other wall of the pair of walls and extending into the other end of the cylindrical screw and provided with a developer outflow opening facing an aperture of the cylindrical screw. Developer outside the cylindrical screw is transported from the outflow pipe to the inflow pipe by the second transporting member and developer in the cylindrical screw is transported from the inflow pipe to the outflow pipe by the first transporting member. Developer is thus circulated inside and outside the cylindrical screw in a manner to ensure proper mixing thereof. The cylindrical screw preferably includes interior and exterior surfaces which have different coefficients of friction for more effective transport of the developer.

24 Claims, 17 Drawing Sheets

FIG. 1
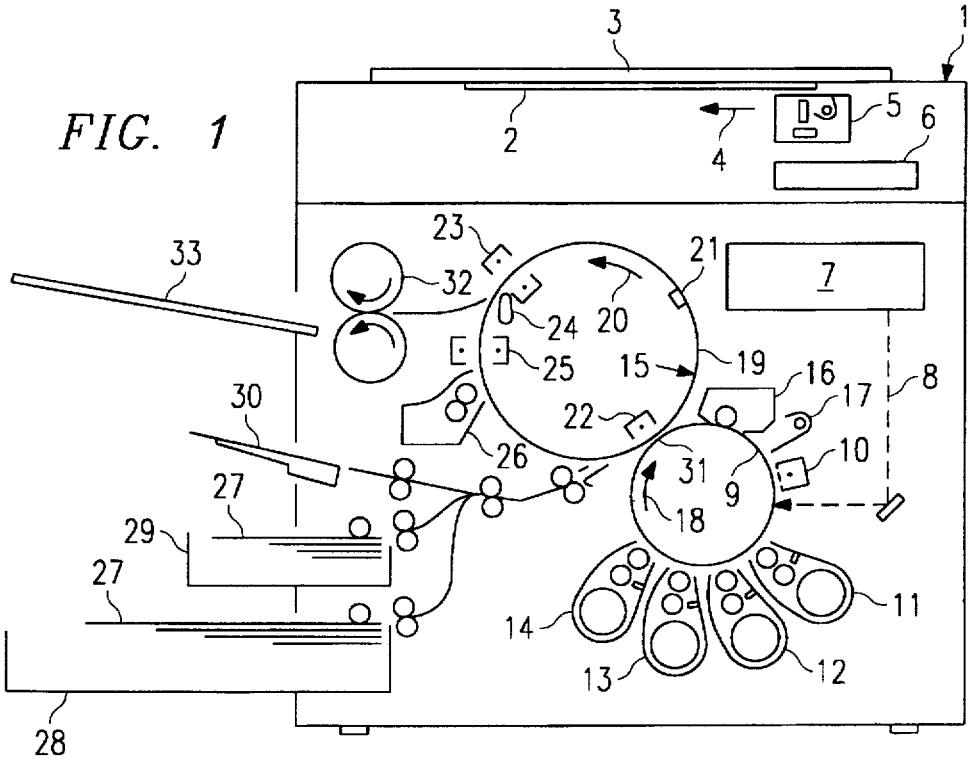
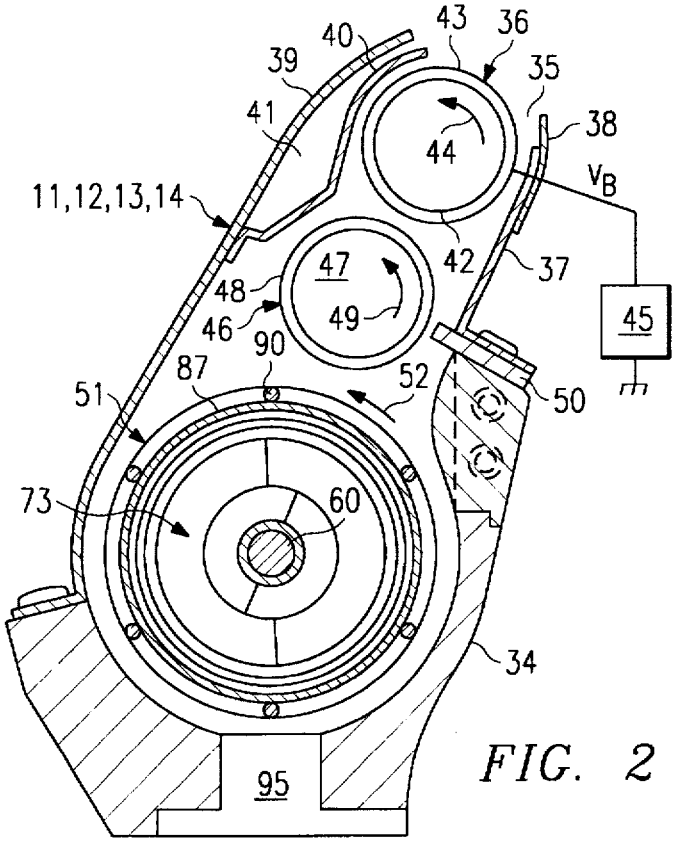
FIG. 2

FIG. 5
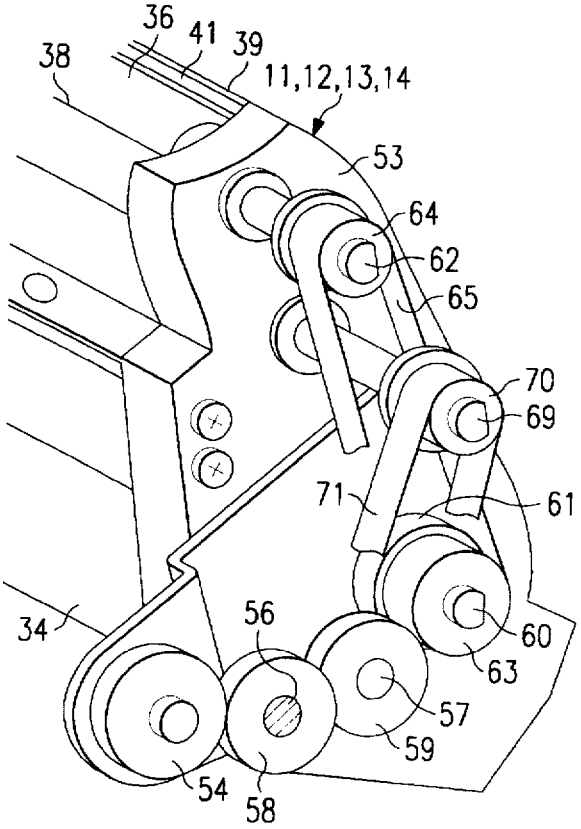
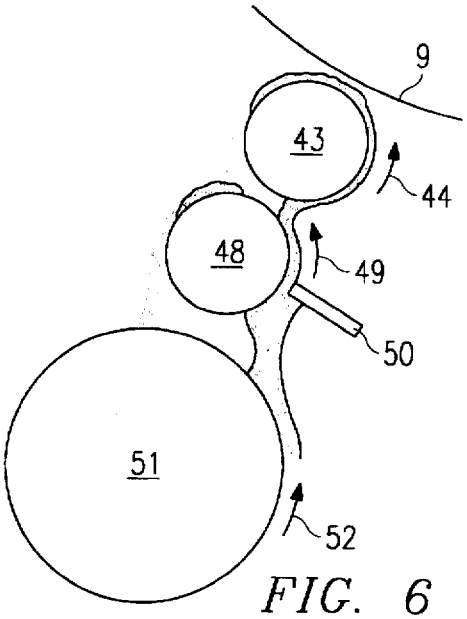
FIG. 6
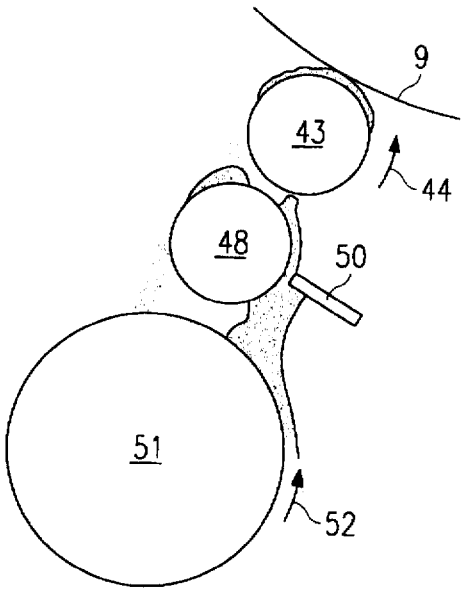
FIG. 7
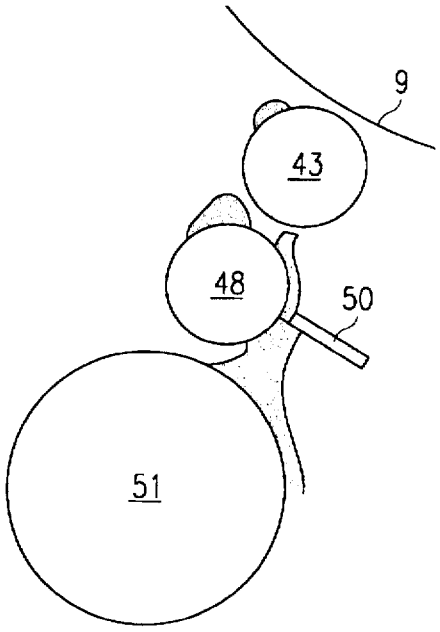
FIG. 8

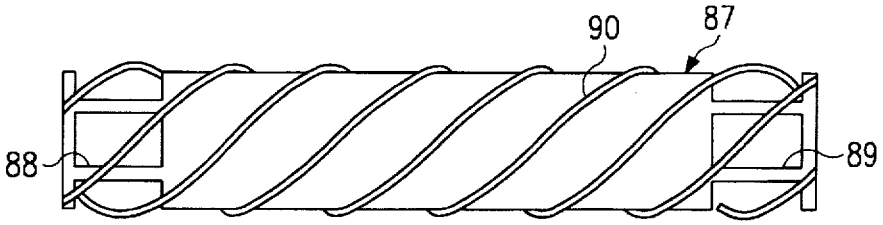
FIG. 12b
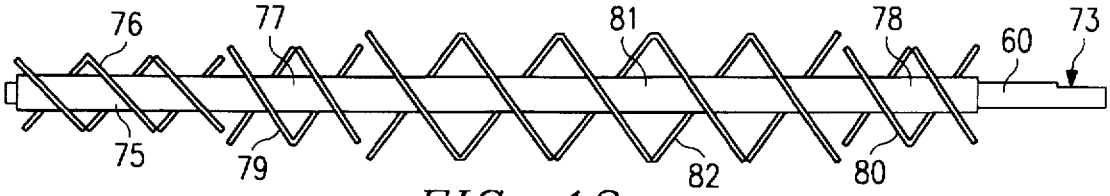
FIG. 12c
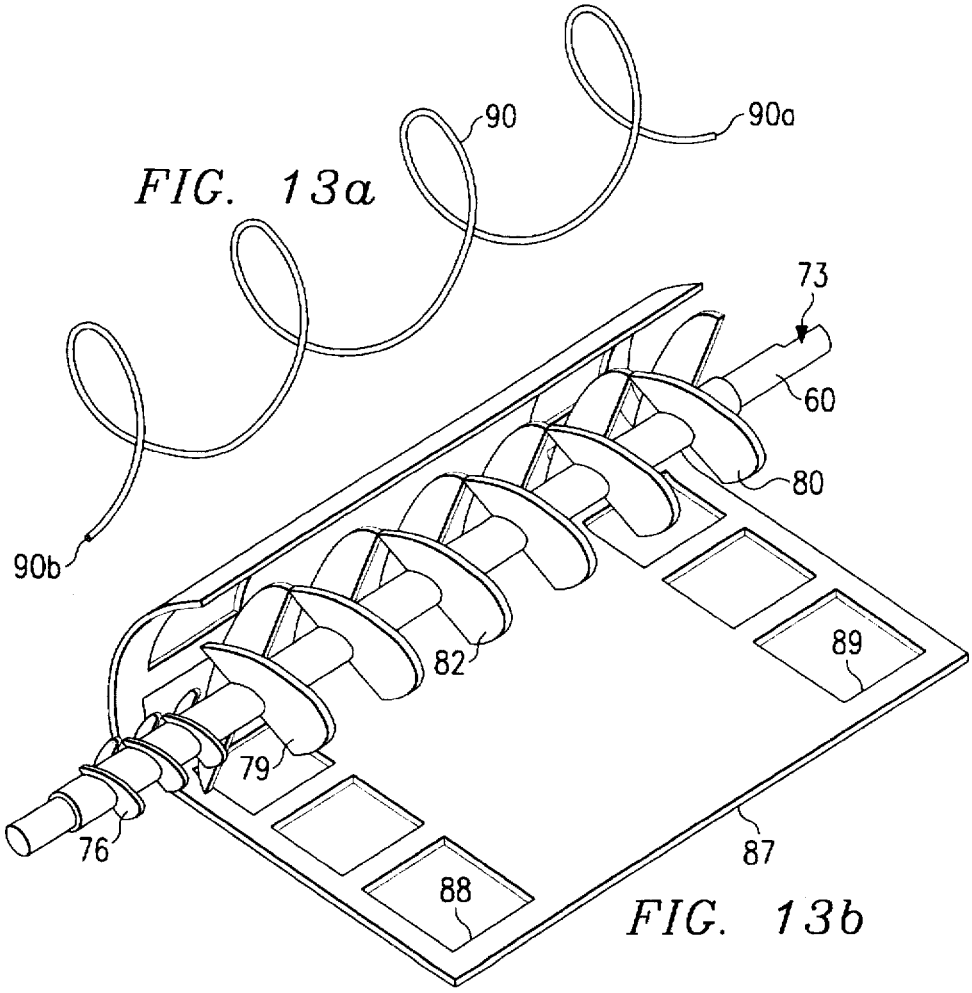
FIG. 13a
FIG. 13b

FIG. 23
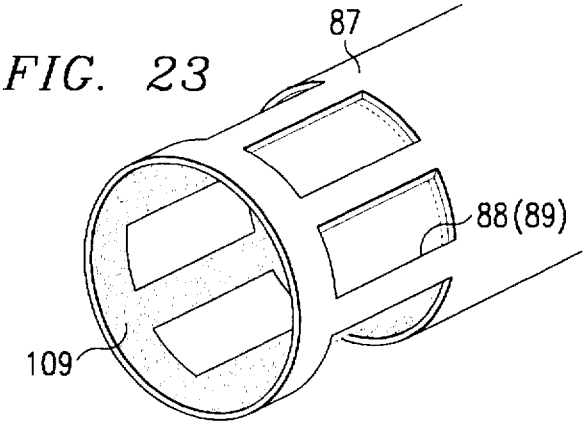
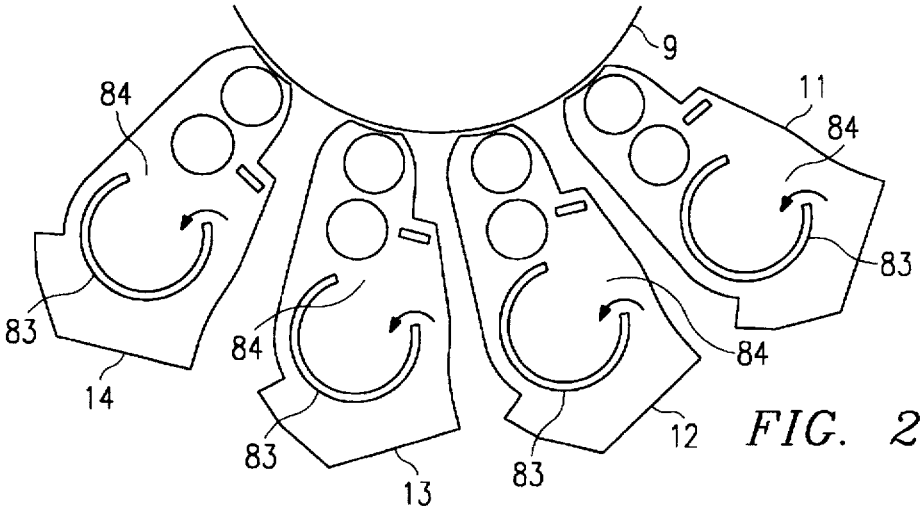
FIG. 24
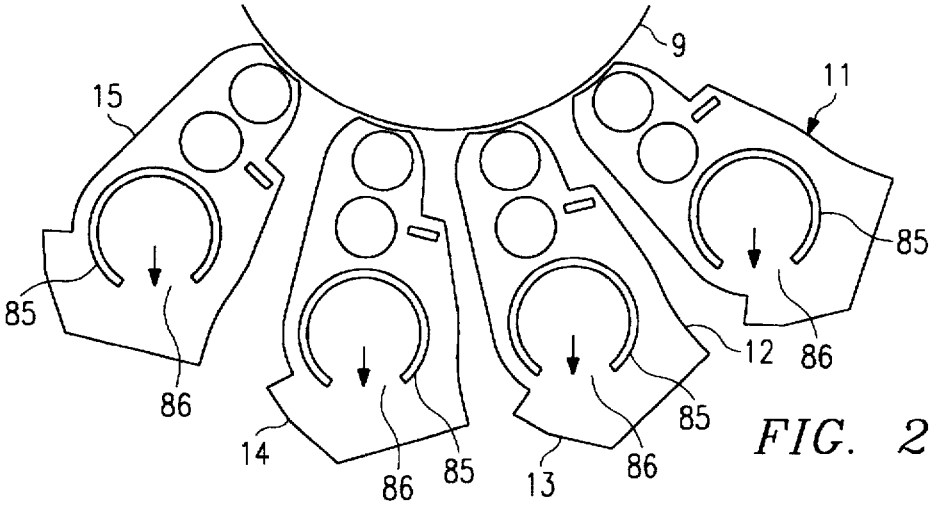
FIG. 25

FIG. 35
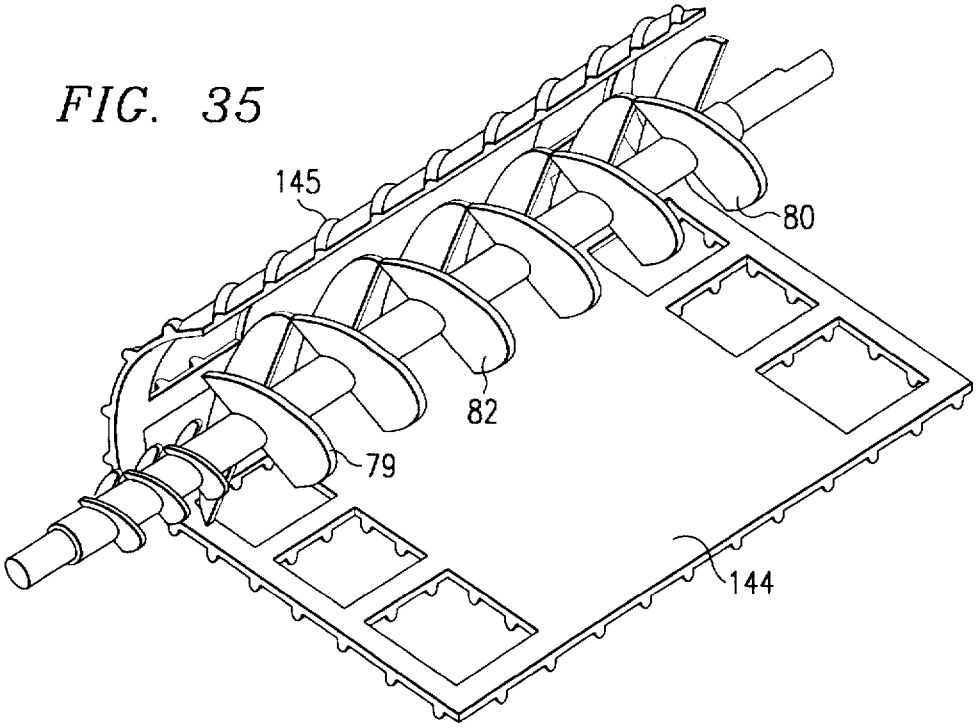
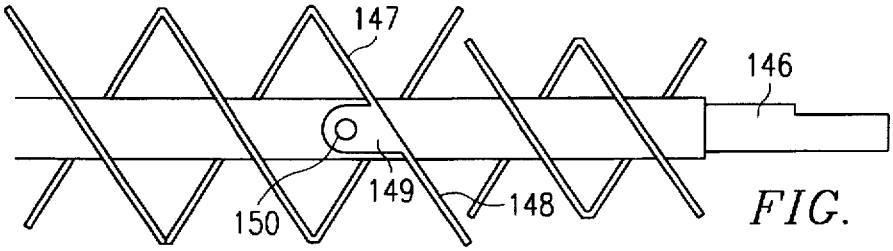
FIG. 36
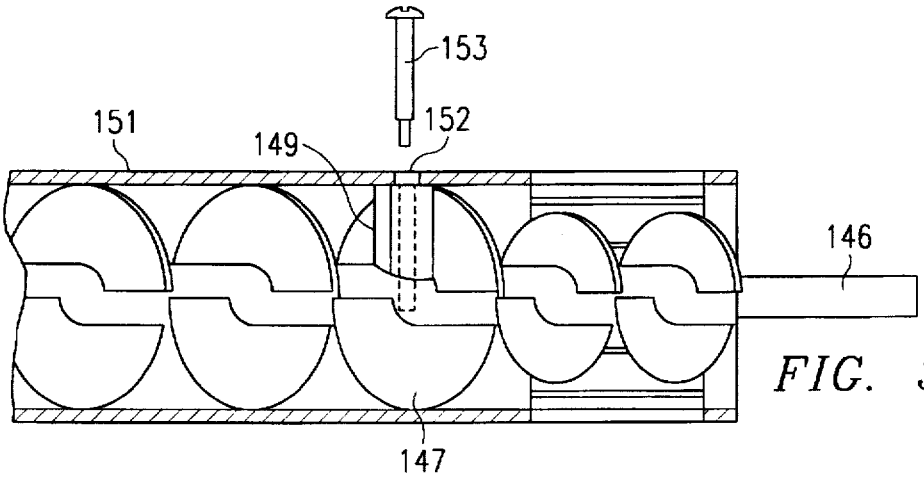
FIG. 37

DEVELOPER MIXING AND TRANSPORTING DEVICE

BACKGROUND OF THE INVENTION

1. Field of the Invention

The present invention relates generally to a developing device for electrophotographic copiers and the like; and, more particularly, to a device for mixing and transporting developer in electrophotographic copiers.

2. Description of the Prior Art

Conventional developer mixing devices include those such as that disclosed in U.S. Pat. No. 5,189,474. The developer mixing device of that patent includes a transport pipe having a developer inflow aperture at one end and a developer outflow aperture at the other end, a screw arranged within the transport pipe for transporting developer from the inflow side to the outflow side, and a mixing roller arranged inside the transport pipe for transporting developer from the outflow side to the inflow side and for drawing up developer and transporting it to an adjacent and separate empty space, so as to accomplish developer circulation inside and outside the transport pipe through the inflow aperture and the outflow aperture.

In the aforesaid type of developer mixing and transporting device, suitable transportability inside the transport pipe must be satisfied in the axial direction via the transporting action of the screw blades. Furthermore, suitable transportability must be satisfied outside of the transport pipe in the axial direction and in the circumferential direction via the mixing roller.

Other conventional developer mixing devices are such as that disclosed in Japanese Utility Model Application No. SHO59-9351. The developer mixing device of that application comprises an inner screw provided with a transport blade on the circumference of a rotating shaft connected to a drive system, an exterior screw sheathing the interior screw and having a transport blade with transportability in the opposite direction relative to the inner screw transport blade on the exterior surface of a cylindrical member and provided with a developer inflow opening on one end of the cylindrical member and a developer outflow opening on the opposite end thereof; and a linkage member integratedly connecting the interior screw and the exterior screw at both ends.

In this developer mixing device, developer transported by the exterior screw is introduced into the cylindrical member through the inflow opening at one end, and the introduced developer is transported to the opposite end by the interior screw and discharged outside the cylindrical member through the outflow opening at the other end, such that the developer is circulated.

Such a developer mixing device as described above has certain disadvantages insofar as developer introduced into the cylindrical member from the inflow opening flows quickly to the exterior from the inflow opening so that only an extremely slight amount of developer is actually transported to the outflow opening at the opposite end, thereby preventing the desired circulation and mixing from occurring.

Furthermore, in electrophotographic copiers and printers which use powder developer, particularly two-component developer comprising a mixture of toner and carrier, the developer deteriorates in conjunction with printing which leads to a reduction in charging characteristics. Thus, it is necessary to remove the developer accommodated in the developing device and replace it with fresh developer at periodic intervals, or after a predetermined number of printings.

Developer mixing members such as screw blades and the like as described above are typically housed in the developing device and used for mixing the developer. Much time and labor is required to replace the developer because the developer between the screw blades cannot be easily removed. Devices which improve conditions for developer replacement in developing devices are particularly desired for full color copiers and printers having a plurality of developing devices.

SUMMARY OF THE INVENTION

In accordance with one aspect thereof, the present invention provides a developer transporting device which includes a pair of walls, a rotating shaft supported on the pair of walls, a first transporting member provided on the rotating shaft, a rotating cylindrical screw concentrically sheathing the rotating shaft and having a second transporting member provided on an exterior surface thereof, and further having a plurality of apertures provided at both ends thereof in the circumferential direction, an inflow pipe fixedly mounted on one wall of the pair of walls and extending into one end of the cylindrical screw and provided with a developer inflow opening at a top region facing an aperture of the plurality of apertures provided in the cylindrical screw, and an outflow pipe fixedly mounted on the other wall of the pair of walls and extending into the other end of the cylindrical screw and provided with a developer outflow opening at a bottom region facing an aperture of the plurality of apertures provided in the cylindrical screw.

According to the aforesaid developer transporting device, developer outside the cylindrical screw is transported from the outflow pipe side to the inflow pipe side by the second transport member; and at a region where the inflow pipe is inside the cylindrical screw, the developer is transported into the cylindrical screw via the aperture provided on the cylindrical screw and the developer inflow opening. On the other hand, the developer inside the cylindrical screw is transported toward the outflow pipe by the first transport member, and discharged outside the cylindrical screw through the outflow pipe opening and the aperture of the cylindrical screw. Thus, developer is circulated mutually inside and outside the cylindrical screw, and will be mixed during the transport by the first and second transporting members.

In accordance with a further aspect of the invention, a developer transporting device for transporting a developer including toner particles includes a rotating shaft, a first transporting member provided on the rotating shaft, and a rotating cylindrical screw concentrically sheathing the rotating shaft and having a second transporting member provided on an exterior surface thereof wherein an interior surface of the cylindrical screw has a coefficient of friction that is less than a coefficient of friction of the exterior surface of the cylindrical screw.

In a developer transporting device according to this aspect, developer is rapidly transported in a predetermined direction via the transporting force imparted by the first transporting member because the interior surface of the cylindrical screw has a small coefficient of friction. On the other hand, suitable transportability is obtained not only in an axial direction by the second transporting member, but also in a circumferential direction by the friction of the exterior surface of the transport path because the exterior surface of the cylindrical developer transport path has a large coefficient of friction.

In accordance with yet a further aspect, the present invention provides a developer transporting device which includes a rotating shaft, a first transporting member provided on the rotating shaft, a rotating cylindrical screw concentrically sheathing the rotating shaft and having a second transporting member provided on the exterior surface thereof, and a removable cap for covering an end of the cylindrical screw.

According to this aspect of the present invention, a developer mixing member serving as a developer accommodating device may be used as a developer mixing member when the caps covering bilateral ends of the cylindrical screw are removed. Conversely, if the caps are mounted, the developer mixing member may be used as a developer accommodating device for accommodating developer inside the cylindrical screw. Accordingly, if the developer mixing member in the state of accommodating developer (developer accommodating device) is installed in a developing device and the caps at the bilateral ends of the member are removed, or if the developer mixing member is installed in the developing device in a state wherein the caps have been removed, developer is loaded in the developing device. When the cylindrical portion of the developer mixing member installed in the developing device are covered by the caps, the developer mixing member can be removed while in a state of accommodating developer therein (developer accommodating device). Thus, developer can be simply removed from a developing device.

Yet further advantages and specific features of the present invention will become apparent from the following detailed description of presently preferred embodiments.

BRIEF DESCRIPTION OF THE DRAWINGS

FIG. 1 is a section view showing the construction of a multicolor copier to assist in explaining the present invention;

FIG. 2 is a section view of a developing device according to the present invention;

FIGS. 4 and 5 are perspective views showing the drive system of the developing device of FIG. 2;

FIGS. 6–9 are illustrations schematically showing the movement of developer within the developing device of FIG. 2;

FIGS. 13(*a*) and (*b*) are exploded perspective views illustrating details of the construction of the mixing screw of FIG. 10;

FIG. 23 is a partial perspective view showing the ends of a screw pipe according to a sixth embodiment of the invention;

FIG. 24 shows the positional relationship of the inflow aperture in each developing device of the copier of FIG. 1;

FIG. 25 shows the positional relationship of the outflow aperture in each developing device;

FIG. 35 is a perspective view showing a mixing screw according to a thirteenth embodiment of the present invention;

FIG. 36 is a front view of a mixing screw according to a fourteenth embodiment of the present invention;

FIG. 37 is a section view of the screw pipe of the mixing screw of FIG. 36;

DETAILED DESCRIPTION OF PREFERRED EMBODIMENTS

1) General Construction

Figure 3:
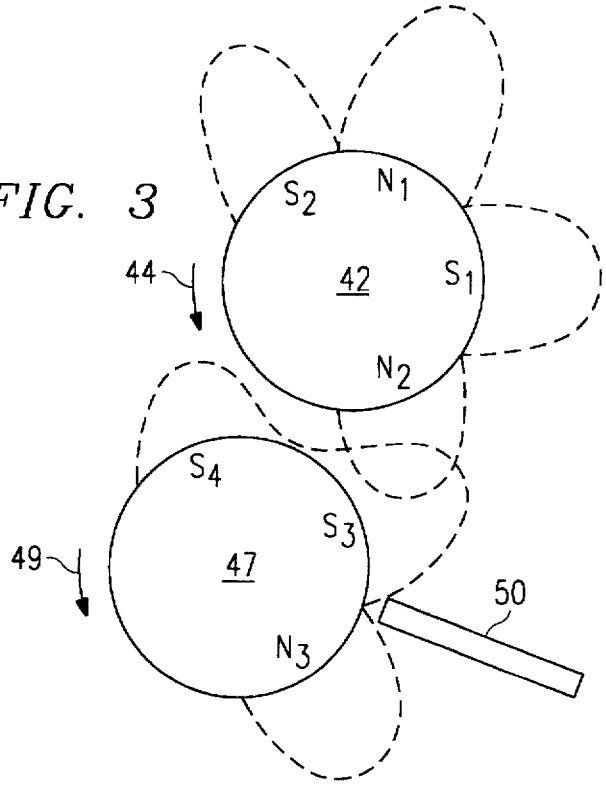
FIG. 3 is an illustration showing the magnetic field distribution of the developing roller and the supply roller of the developing device of FIG. 2.

FIG. 1 shows the construction of a multicolor image forming apparatus of an electrophotographic type, i.e., multicolor copier 1. Copier 1 is provided with a document platen 2 comprising a transparent glass plate, and a document cover 3 which opens and closes on the top surface of the document platen 2. A document is placed on document platen 2 with the image surface thereof facing down, and is covered with document cover 3. Optical scanning unit 5 for reading the images of documents placed on document platen 2 is arranged below document platen 2 and operates along the bottom surface of the platen 2 in the direction of arrow 4. A document image read by scanning unit 5 is broken down into four values of image data (yellow, magenta, cyan, black) and the image data is stored in image memory 6. Image data stored in image memory 6 is transmitted to laser exposure device 7 in the sequence yellow, magenta, cyan, black; and laser beam 8 modulated corresponding to the respective image data is exposed on an electrostatic latent image-bearing member, i.e., photosensitive member 9.

Photosensitive member 9 comprises a drum having a photosensitive layer on its exterior surface. Arranged sequentially around the periphery of photosensitive member 9 are charger 10, developing, transfer device 11, 12, 13, 14, transfer device 15, cleaning device 16, and discharger 17. When photosensitive member 9 is rotated in the direction of arrow 18, the photosensitive layer provided on the exterior surface thereof is uniformly charged by charger 10; and the charged region is then optically exposed by laser 8 so as to sequentially form electrostatic latent images thereon corresponding to the yellow, magenta, cyan and black image data. These electrostatic latent images are developed by developing devices 11, 12, 13 and 14 accommodating yellow, magenta, cyan and black toners, respectively, so as to render the latent images visible; and the developed toner images are sequentially transferred by transfer device 15 to a transfer sheet (e.g., a paper sheet) so as to be overlaid one upon another. Toner not transferred to the transfer sheet is collected by cleaning device 16, and residual charge remaining on the surface of photosensitive member 9 is removed by discharger 17 in preparation for the next developing process.

Transfer device 15 includes a transfer drum 19 which rotates in the direction of arrow 20. Transfer drum 19 is provided with a chucking device 21 to hold the leading edge portion of a transfer sheet on the exterior surface of the drum. Transfer charger 22 is arranged facing photosensitive drum 9 in a cavity within transfer drum 19. First discharger 23, sheet separation device 24, second discharger 25, and cleaning device 26 are sequentially arranged in proximity to the movement track of transfer drum 19 downstream from transfer charger 22 in the direction of rotation of transfer drum 19.

A transfer sheet 27 is supplied from any one of paper cassette 28, 29 or 30, and is supported on the exterior surface of transfer drum 19 by chucking device 21. Transfer sheet 27 is transported to the section of confrontation between photosensitive member 9 and transfer drum 19 via the rotation of transfer drum 19, and the yellow toner image is transferred from the photosensitive member 9 onto the sheet during the first rotation. With each subsequent rotation of transfer drum 19, the magenta, cyan and black toner images are also transferred onto the sheet so as to be overlaid one upon another. The leading edge of transfer sheet 27 is adjusted so as to register the toner images, such that all of the toner images are overlaid without positional drift.

When transfer of all the toner images is completed, transfer sheet 27 is discharged by first discharger 23 and separated from transfer drum 19 by separation device 24. The toner image on the sheet is then heat-fixed by fixing device 32, and the sheet is thereafter discharged to discharge tray 33. On the other hand, any electrical charge remaining on transfer drum 19 from which transfer sheet 27 has been discharged is itself discharged by second discharger 25, and any residual toner remaining on the transfer drum 19 is removed by cleaning device 26.

2) Developing Devices 11–14

Developing devices 11, 12, 13, 14 are provided with identical basic constructions. Specifically, with reference to FIG. 2, developing devices 11–14 each have a housing 34 in which is formed an aperture 35 at the section thereof which confronts the photosensitive member 9. On the inner side of aperture 35 a developing roller 36 is provided which faces photosensitive member 9 and which slightly protrudes from the aperture 35. A dust shield 38 is adhered to the edge of one wall 37 of housing 34 opposite the exterior surface of developing roller 36, and is disposed such that the leading edge thereof confronts photosensitive member 9 in a state of non-contact therewith. A partition 40 is arranged at the inner side of the other wall 39 of housing 34 facing the exterior surface of developing roller 36, and a toner dust collection compartment 41 is formed between wall 39 and partition 40 in a manner such that the compartment 41 opens to the section facing photosensitive member 9. Connected to the toner dust collection compartment 41 is a suction device, not shown in the drawing.

Developing roller 36 comprises a stationary magnet member 42 mounted in a non-rotating state, and a developing sleeve 43 which sheaths the magnet member 42 and is rotatably driven in the direction of arrow 44. Developing roller 36 is connected to developing bias power unit 45.

A supply roller 46 is also provided within housing 34 and is disposed below developing roller 36 at a predetermined spacing relative thereto. Supply roller 46 comprises, similar to developing roller 36, a stationary magnet member 47 mounted in a non-rotating state, and a supply sleeve 48 which sheaths the magnet member 47 and is rotatably driven in the direction of arrow 49. A brush height-regulating member 50 is attached to housing 34 and is disposed to face the exterior surface of supply sleeve 48 so as to maintain a predetermined spacing therebetween.

A developer mixing screw 51 (to be described in detail hereinafter) is provided in housing 34 below supply roller 46. Developer mixing screw 51 rotates in the direction of arrow 52 to mix the developer, i.e., a two-component developer comprising a toner and a carrier, accommodated in housing 34.

Magnet members 42 and 47 are each provided with a plurality of magnetic poles, as shown in FIG. 3. In FIG. 3, N and S refer to magnetic polarities. Specifically, magnet member 42 of developing roller 36 is provided with a magnetic pole N1 which functions as a developing magnetic pole and is disposed at the section of confrontation between developing roller 36 and photosensitive member 9. A magnetic pole N2 is arranged downstream from the position of greatest proximity between developing roller 36 and supply roller 46 in the direction of rotation of developing sleeve 43 (the direction of arrow 44). Furthermore, a magnetic pole S1 is arranged between magnetic poles N1 and N2, and a magnetic pole 42 is arranged downstream from magnetic pole N1 relative to the direction of rotation of developing sleeve 43.

On the other hand, magnet member 47 of supply roller 46 is provided with a magnetic pole 53 arranged upstream from the section of confrontation between the member 42 and the member 47 relative to the direction of rotation of supply sleeve 48 (the direction of arrow 49), and a magnetic pole 54 having the same polarity arranged downstream therefrom so as to circumscribe the section of confrontation between magnet member 47 and developing sleeve 43. A magnetic pole N3 is arranged upstream from the section of confrontation with brush height-regulating member 50 in the direction of rotation of supply sleeve 48.

With reference to FIGS. 2 and 3, by virtue of the aforesaid construction, developer accommodated in housing 34 is mixed by mixing screw 51, and the toner and carrier are charged to predetermined polarities. Developer drawn up by mixing screw 51 is supplied to supply roller 46 at the region confronting magnetic pole N3, and is maintained on the exterior surface of supply sleeve 48 via the magnetic force of magnetic pole N3. Developer is transported in the same direction via the rotation of supply sleeve 48 in the direction of arrow 49, is regulated by brush height-regulating member 50, and forms a bank. Developer that passes between brush height-regulating member 50 and supply roller 46 is delivered to developing sleeve 43 at the section of confrontation between magnetic pole S3 and magnetic pole N2. Then, developer is moved opposite developing magnetic pole N1 after passing magnetic pole S1 via the rotation of developing sleeve 43 in the direction of arrow 44, and comes into contact with photosensitive member 9 to develop the electrostatic latent image thereon with toner. Developer that has passed the developing region passes opposite magnetic pole S2, is removed from developing sleeve 43 via the repulsive magnetic field formed between magnetic poles S2 and S4, and drops to supply roller 46. The introduction of developer between developing sleeve 43 and supply sleeve 48 is prevented by the aforesaid repulsive magnetic field. Developer that drops to supply roller 48 falls toward mixing screw 51, and is again mixed by the mixing screw 51. Toner dust scattered from aperture 35 opposite photosensitive member 9 is prevented from scattering outside housing 34 by dust shield 38, and is suctioned into dust collection compartment 41 for collection.

3) Developing Device Drive System

Figure 4:
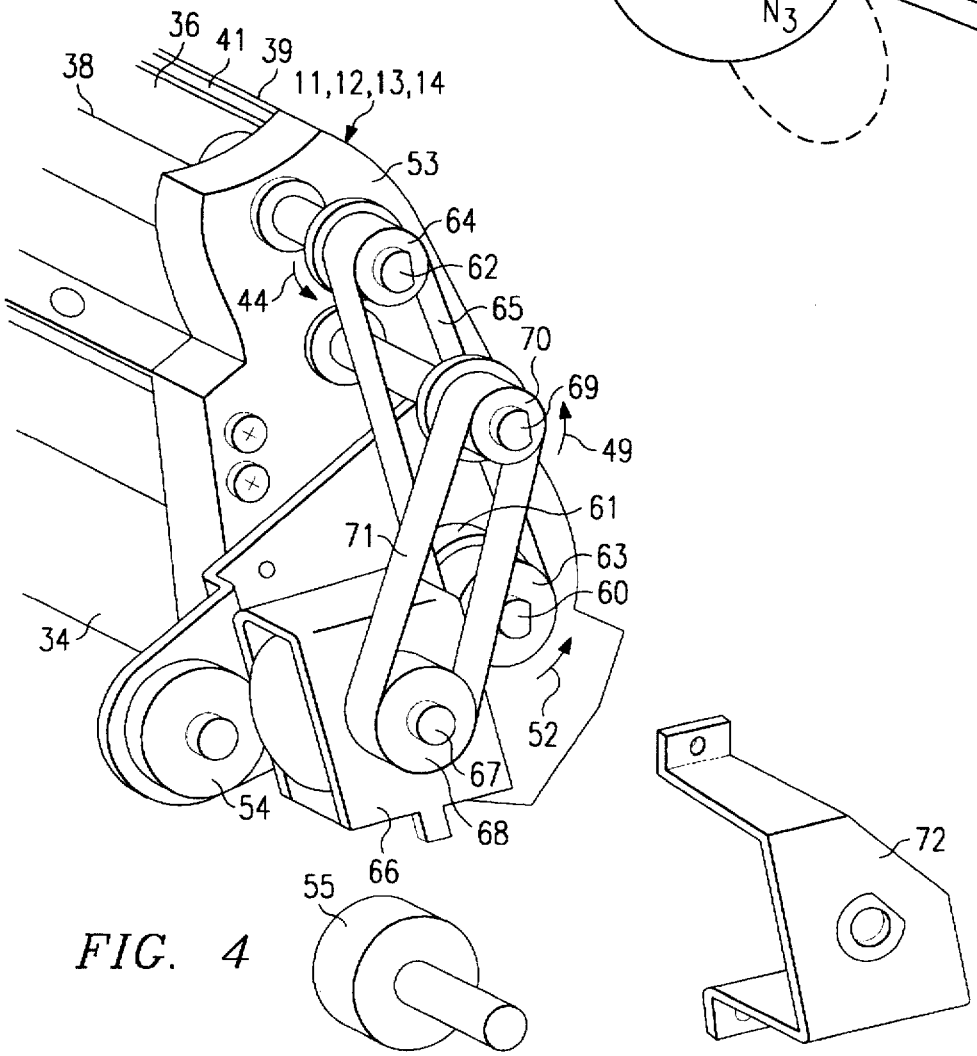

The drive system of developing devices 11, 12, 13, 14 is described hereinafter with reference to FIGS. 4 and 5. An input gear 54 mounted to housing 34 is drivably connected to a drive gear 55 when developing devices 11, 12, 13, 14 are respectively installed in copier 1. Drive gear 55 is connected to a motor via a drive clutch (not illustrated) relative to each developing device, and transmits rotation to input gear 54 when the drive clutch is ON. Input gear 54 is drivably connected to a gear 61 fixedly attached to rotating shaft 60 of mixing screw 51 via idler gears 58 and 59 supported on rotating shafts 56 and 57, respectively. Pulleys 63 and 64 are fixedly attached to rotating shaft 60 and rotating shaft 62 of developing sleeve 43, respectively, and belt 65 is looped around pulleys 63 and 64. Rotating shaft 67 is connected to rotating shaft 56 of idler gear 58 via electromagnetic clutch 66, and belt 71 is looped around pulley 70 fixedly attached to rotating shaft 69 of supply sleeve 48. Electromagnetic clutch 66 is supported on side wall 53 of housing 34 by support frame 72.

According to the aforesaid drive system, the rotation of drive gear 55 is transmitted to rotating shaft 60 via input gear 54, idler gears 58 and 59, and gear 61 when the drive clutch (not illustrated) is ON, so as to rotate mixing screw 51 is the direction of arrow 52. When rotating shaft 60 is rotated, rotating shaft 62 is rotated via pulleys 63 and 64 and belt 65, such that developing sleeve 43 is rotated in the direction of arrow 44. Supply sleeve 48 is rotated via pulleys 68 and 70 and belt 71 in conjunction with the connections to rotating shaft 56 and rotating shaft 67 when electromagnetic clutch 66 is ON. That is, supply sleeve 48 is switchable between a rotating state and a non-rotating state by means of the ON/OFF switching of electromagnetic clutch 66 in the state wherein developing sleeve 43 and mixing screw 51 are driven.

4) Developing Device Selection

Developing devices 11, 12, 13, 14 are respectively switchable between developing and non-developing states by control of electromagnetic clutch 66. Specifics of selection of the respective developing devices are described below with reference to FIGS. 6–9. In switching a developing device from the developing state to the non-developing state, when electromagnetic clutch 66 is turned ON with the drive clutch in the ON state, developing sleeve 43 and mixing screw 51 are rotated in the directions of arrows 44 and 52, respectively, and supply sleeve 48 is rotated in the direction of arrow 49. Thus, the developer drawn up by mixing screw 51 is supplied from supply sleeve 48 to developing sleeve 43, and developer that has passed the developing region is returned to mixing screw 51 via supply sleeve 48 (refer to FIG. 6).

When magnetic clutch 66 is turned OFF from the ON state, the rotation of supply sleeve 48 is stopped. However, the rotation of developing sleeve 43 and mixing screw 51 continues. As a result, developer drawn up from mixing screw 51 collects in the vicinity of brush height-regulating member 50 via the magnetic force of magnetic pole N3. Developer maintained on developing sleeve 43 is transported in the direction of arrow 44 via the rotation of developing sleeve 43, and drops to supply sleeve 48 (refer to FIG. 7).

At the moment electromagnetic clutch 66 is turned OFF, the clutch corresponding to each developing device is turned OFF with a timing such that developer on developing sleeve 43 opposite supply sleeve 48 passes the developing region. Thus, developing sleeve 43 and mixing screw 51 are both stopped together to accomplish the change from the developing state to the non-developing state (refer to FIG. 8).

Figure 9:
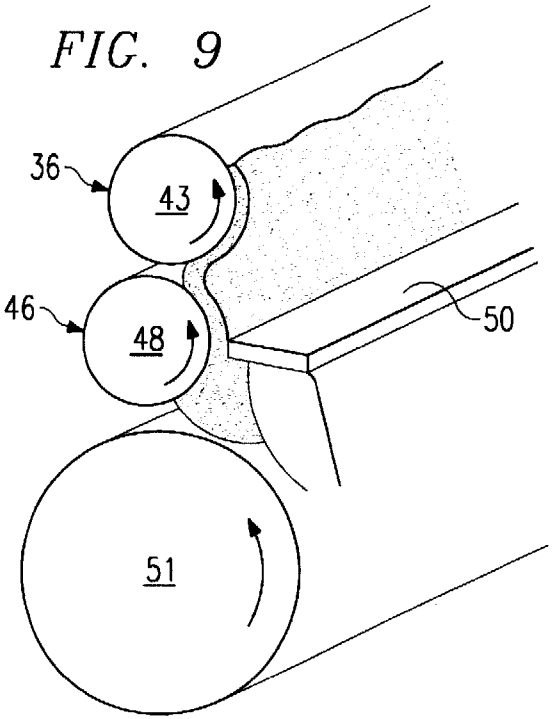

Conversely, when a developing device is switched from the non-developing state to the developing state, developing sleeve 43 and mixing screw 51 are rotated, electromagnetic clutch 66 is turned ON, and supply sleeve 48 is then rotated. Thus, as shown in FIG. 9, developer regulated by brush height-regulating member 50 is supplied all at once from supply sleeve 48 to developing sleeve 43, transported to the developing region, and comes into contact with photosensitive member 9. Accordingly, developing devices 11, 12, 13, 14 can be rapidly switched from the non-developing state to the developing state.

5) Mixing Screw Construction and Operation

Figure 10:
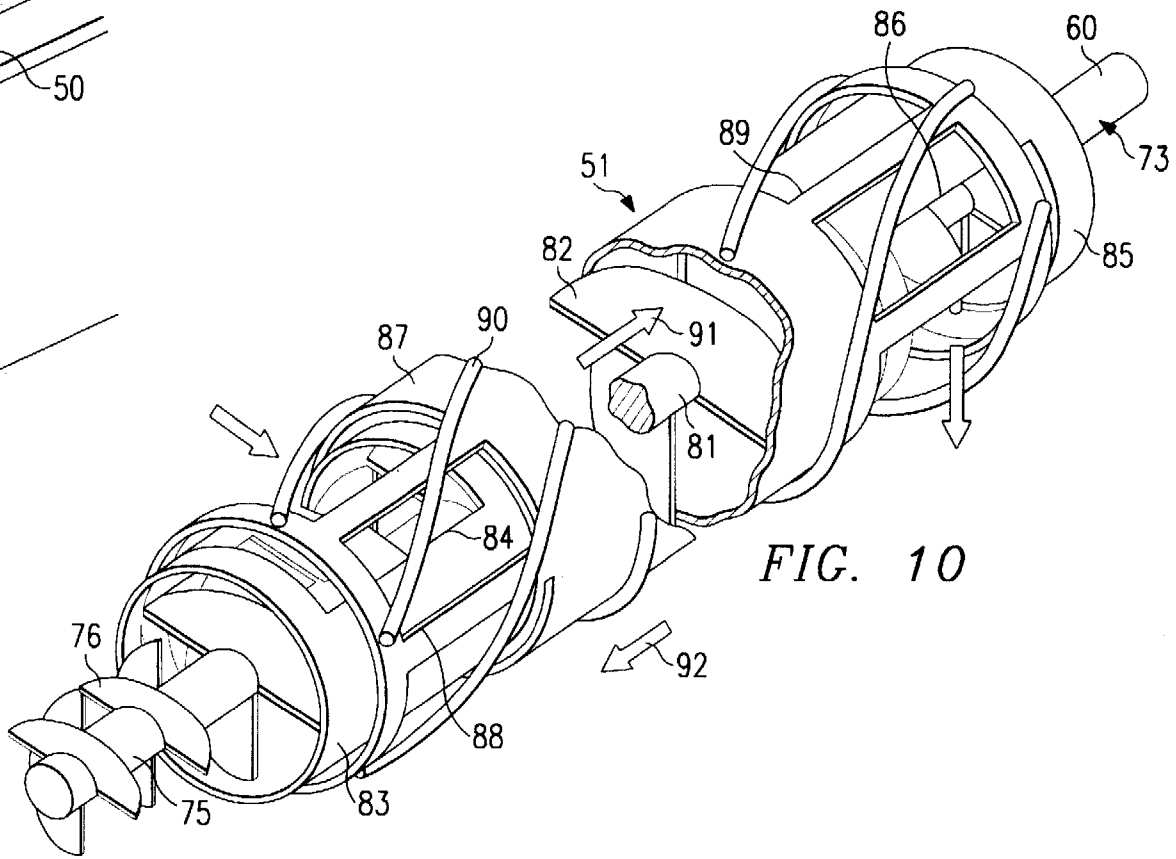
FIG. 10 is a perspective view of a mixing screw incorporated in the developing device of FIG. 2.
Figure 11:
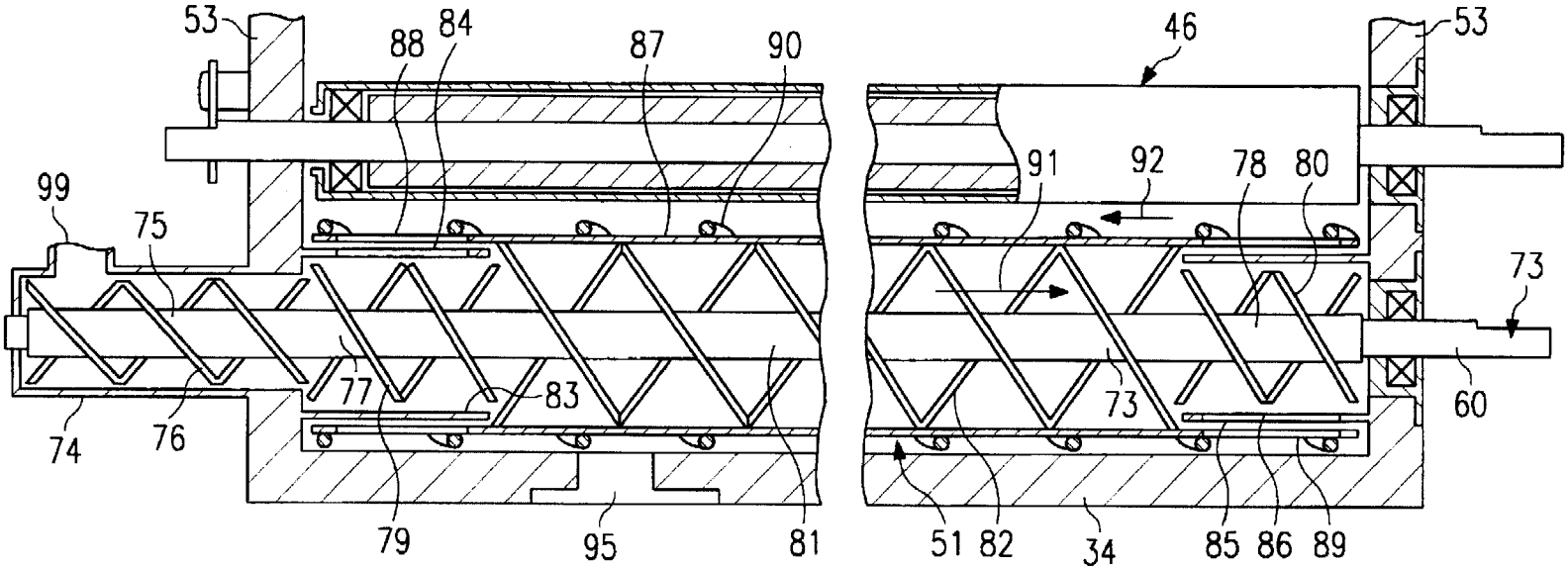
FIG. 11 is a section view of a portion of the developing device of FIG. 2 incorporating the mixing screw of FIG. 10.
Figure 12A:
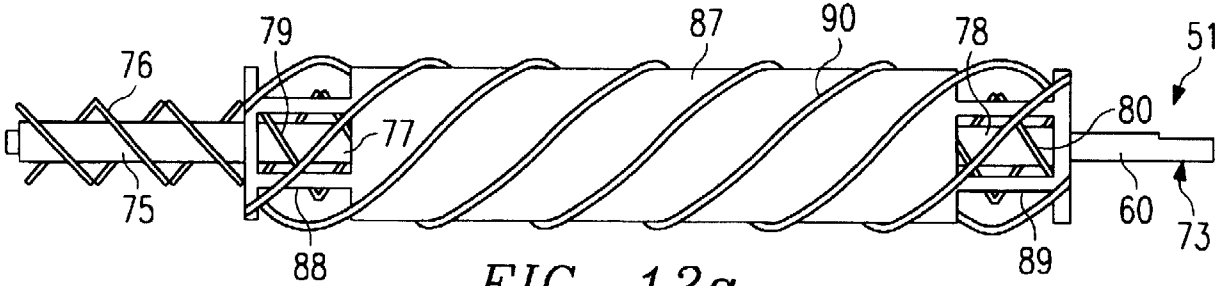
FIGS. 12(*a*), 12(*b*) and 12(*c*) are plan views showing components of the mixing screw of FIG. 10.

Mixing screw 51 is described in detail with reference to FIGS. 10–12. The rotating shaft 60 of mixing screw 51 is arranged in a toner replenishment path 74 which extends outwardly from housing side wall 53 of housing 34, and a replenishment blade 76 having a diameter slightly smaller than the diameter of toner replenishment path 74 is provided on the portion 75 of rotating shaft 60 that is positioned in toner replenishment path 74. An inflow transport blade 79 and an outflow transport blade 80, each having a diameter larger than the aforesaid replenishment blade 76, are provided on rotating shaft portions 77 and 78 which are contained in regions extending inwardly from the opposite side walls 53 of housing 34 by predetermined distances. A center transport blade 82 having a diameter larger than inflow and outflow transport blades 79 and 80 is provided on rotating shaft portion 81 between transport blades 79 and 80. Internal screw 73 comprises the aforesaid rotating shaft 60, replenishment blade 76, and transport blades 79, 82 and 80.

An inflow pipe 83 having a diameter larger than inflow transport blade 79 and smaller than center transport blade 82 concentrically sheaths the region of inflow transport blade 79 adjacent to toner replenishment path 74, and one end of the inflow pipe 83 is fixedly mounted to housing side wall 53. Inflow pipe 83 is provided with toner inflow aperture 84, which faces upward at a predetermined angle. An outflow pipe 85 having the same diameter as inflow pipe 83 concentrically sheaths the region of outflow transport blade 80 at the opposite side, and one end of pipe 85 is fixedly mounted to the opposite side wall 53 of housing 34. Outflow pipe 85 is provided with a toner outflow aperture 86, which faces downward.

A screw pipe 87 sheaths the region of large-diameter center transport blade 82 and is fixedly anchored thereto. The ends of pipe 87 surround, but do not contact, inflow pipe 83 and outflow pipe 85. A plurality of apertures 88 and 89 are formed at equal spacings in the circumferential direction in the portions of screw pipe 87 which cover inflow pipe 83 and outflow pipe 85. Spiral-shaped rib 90 is formed around the exterior surface of screw pipe 87.

When mixing screw 51, constructed as described above, rotates in the direction of arrow 52 by means of the transmission of rotation of rotating shaft 60; developer positioned inside screw pipe 87 is transported in the direction of arrow 91 via the rotation of transport blade 82, and passes through outflow aperture 86 of outflow pipe 85 and apertures 89 of screw pipe 87, so as to flow out of screw pipe 87. Developer outside screw pipe 87 is transported in the opposite direction, i.e., in the direction of arrow 92, via the rotation of ribs 90. Developer is drawn up by ribs 90 and is supplied to supply roller 46. Developer transported to the toner replenishment side is not supplied to supply roller 46, and falls inside inflow pipe 83 through apertures 88 of screw pipe 87 and inflow aperture 84 of inflow pipe 83, and is transported in the direction of arrow 91 inside screw pipe 87 via the transport blades 79, 82 and 80. Toner and carrier of the developer thusly transported make mutual friction contact and are charged to a predetermined polarity.

When toner density is determined to be less than a standard density based on the detection results of toner density sensor 95, toner is resupplied to toner replenishment path 74 from a toner replenishment device (not shown in the drawings) through toner replenishment aperture 99. The resupplied toner is transported inside housing 34 in conjunction with the rotation of toner replenishment blade 76, passes into inflow pipe 83, and is resupplied to the developer transported inside screw pipe 87. Resupplied toner is mixed with the developer so as to come into contact with the carrier, and is thereby charged to a predetermined polarity and electric potential.

According to the above-described construction, inflowing developer is transported completely inside screw pipe 87 because inflow aperture 84 is the only aperture thereof that faces upward. That is, developer inside screw pipe 87 does not flow out from inflow aperture 84. On the other hand, outflow aperture 86 is the only aperture that faces downward, such that developer near outflow aperture 86 is prevented from flowing into pipe 87.

Accordingly, the efficiency of developer inflow and outflow can be improved by having apertures 84 and 86 face upward and downward, respectively.

Mixing screw 51 may be constructed as follows. As shown in FIGS. 13(*a*) and 13(*b*), internal screw 73 comprises rotating shaft 60 having transport blades 76, 79, 82 and 80 mounted thereon so as to be integratedly formed by injection molding. Screw pipe 87 may comprise a synthetic resin sheet comprising polyethylene, polypropylene or the like having a thickness of about 100 μm, or it may comprise a thin metal plate of stainless steel or the like which is rolled such that the aforesaid screw 73 is disposed on the interior side thereof, wherein the contact portion relative to transport blade 82 and the edge portion of the butted sheet or the like is fixedly anchored with adhesive. Exterior rib 90 of screw pipe 87 is formed by a coil spring wrapped around screw pipe 87. This coil spring has a diameter smaller than that of screw pipe 87 such that when wrapped around screw pipe 87, it is in a state of being clamped around screw pipe 87 without a gap therebetween via the compression force of the coil spring. It is desirable that the ends of the coil spring be provided with stops 90*a* and 90*b* which are curved inwardly, and that the stops 90*a* and 90*b* engage a channel or hole (not shown) provided in screw pipe 87 so as to prevent position drift.

When mixing screw 51 is constructed as described above, manufacture of the mixing screw is both simple and inexpensive. Furthermore, since the thickness of screw pipe 87 is small, there is only a slight difference in the internal diameter and external diameter of screw pipe 87, thereby allowing a large diameter mixing screw to be used so as to improve developer transportability. As will be described hereinafter, screw pipe 87 may also be manufactured using a sheet in which the interior surface and the exterior surface thereof are surface-processed differently in accordance with requirements, and in which processing of the apertures communicating from the interior to the exterior thereof can be readily accomplished.

6) Surface Finishing of Interior and Exterior Surfaces of the Screw Pipe

Figure 14:
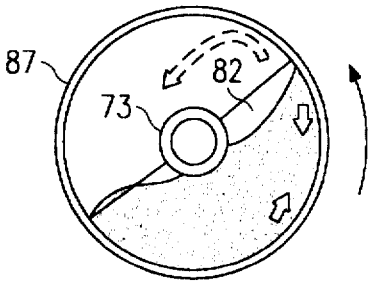
FIG. 14 is an illustration showing the movement of developer inside a screw pipe of the mixing screw of FIG. 10.

As shown in FIG. 14, in the interior of mixing screw 51, developer is lifted upward via contact with the interior wall surface of screw pipe 87. Developer is lifted to a position perpendicular to the interior wall surface, and normally moves in the axial direction along the inclined surface of transport blade 82 when falling naturally without being lifted higher. However, when the rotational speed of transport blade 82 is increased, developer is lifted upward above a position perpendicular to the interior wall surface, and is transported to the opposite side of rotating shaft 60 (as indicated by the arrow), thereby reducing developer transportability. In order to prevent a reduction in developer transportability due to the aforesaid cause, it is necessary to suppress the lifting of developer by the interior wall surface by reducing the friction resistance of the interior wall surface of screw pipe 87 relative to the developer.

Figure 15:
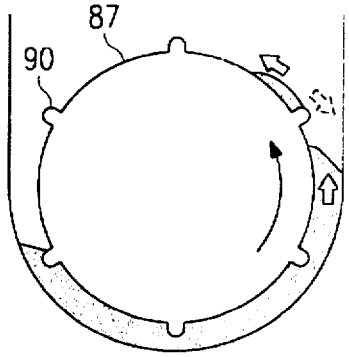
FIG. 15 is an illustration showing the movement of developer outside a screw pipe of the mixing device of FIG. 10.

On the other hand, on the exterior side of screw pipe 87, it is necessary to lift the developer higher than a position perpendicular to the exterior wall surface of screw pipe 87, as shown in FIG. 15, in order to supply developer to supply roller 46. Thus, it is necessary to increase the friction resistance of the exterior wall surface of screw pipe 87 relative to the developer.

In mixing screw 51, the interior wall surface of screw pipe 87 may be finished to a mirror surface to minimize roughness of the wall surface, coated with a material having minimal surface resistance (e.g., a fluororesin or a silicone resin), or treated with a material to which toner has difficulty adhering (e.g., a material charged to the same polarity as the toner). The exterior surface of screw pipe 87, on the other hand, may be treated by a blasting process, or knurling.

The surface roughness of the wall surfaces is described hereinafter. The relationship between wall surface friction force and surface roughness in the case of transporting two-component developer is expressed by the effect that friction force is reduced when the surface roughness is set to be less than the corresponding carrier particle size, and expressed by the effect that friction force is increased when the surface roughness is set to be greater than the corresponding toner particle size. The friction force between toner and wall surfaces having an intermediate surface roughness is greater than the friction force between a toner and wall surfaces having a surface roughness corresponding to the toner particle size at an initial stage, but developer transporting force is reduced to the point of a wall surface having a surface roughness corresponding to the toner particle size due to the gradual filling in of irregularities in the wall surface with toner particles. Accordingly, the surface roughness of the interior surface of screw pipe 87 have a ten-point mean roughness Rz which is desirably no more than about one-half, and preferably less than one-half, the toner particle size to minimize the friction force with the wall surface. Specifically, from our experiments, when the average toner particle size is 12 μm, surface roughness Rz is less than 6.3 μm, and is preferably less than 3.2 μm. On the other hand, it is desirable that the exterior surface of screw pipe 87 has a ten-point mean roughness equivalent to or greater than the carrier particle size. Specifically, when the average carrier particle size is 50 μm, surface roughness Rz is 50 μm or greater, and preferably 100 μm or greater.

Coating materials suitable for minimizing the surface energy of the interior wall surface of the screw pipe include fluororesins (polytetrafluoroethyl vinyl ether, fluoroethylene-propylene, polytetrafluoroethylene), silicone resin, and polyamide resin.

Materials to which toner has difficulty adhering include materials having a different charge polarity than the toner. For example, if the toner is charged with a negative polarity, suitable chemical materials include Teflon, polyethylene, polyester and polyethylene terephthalate; and metallic materials including nickel, chrome and copper. On the other hand, if the toner is charged with a positive polarity, suitable chemical materials include acrylic, nylon, polycarbonate, polyacetal and ABS; and metallic materials such as aluminum, iron and the like.

Processing methods may include forming the entire screw pipe with the aforesaid materials, or processing at least the interior wall surface with the aforesaid materials using coating, plating or vacuum deposition methods. Furthermore, the interior wall surface alone may be constructed of a separate sheet-like component, inserted between the screw pipe and transport blade and attached thereto. When a special expensive material is used, the latter two methods described above will result in an inexpensive manufacturing cost.

Figure 16:
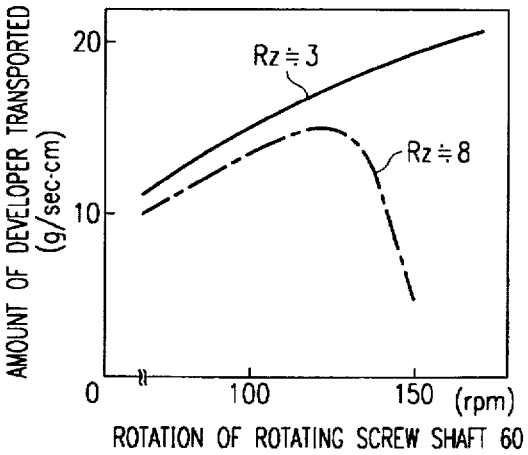
FIGS. 16 and 17 show the experimental results of determining the relationship between the amount of developer drawn up and the rotational speed of the screw pipe.

An aluminum screw pipe processed to achieve a surface roughness Rz≈3 on the interior wall surface, and an aluminum screw pipe having an unprocessed interior wall surface (Rz≈8) were used to determine the amount of developer transported inside the screw pipes. The results are shown in FIG. 16, and indicate that in the surface-processed screw pipe, the amount of developer transported increased proportionally to the increase in rotational speed. However, in the screw pipe that was unprocessed, the amount of developer transported peaked when the rotational speed reached about 130 rpm, the dropped precipitously when the rotational speed was increased above that speed.

Similar results to those shown in FIG. 16 were obtained when a polyethylene sheet having a high degree of surface smoothness was inserted along the interior surface of the screw pipe instead of surface processing the interior surface. Similar results were also obtained when the screw pipe was formed with synthetic resin using a metal mold having a smooth surface (i.e., surface in contact with the molding material).

Figure 17:
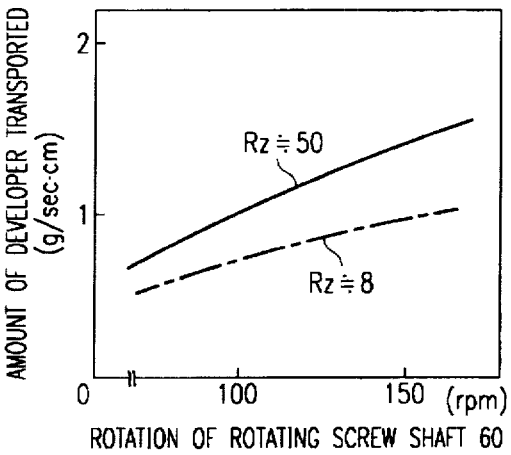

An aluminum screw pipe processed by blasting to achieve a surface roughness Rz≈50 on the exterior wall surface, and an aluminum screw pipe having an unprocessed exterior wall surface (Rz≈8) were used to determine the amount of developer supplied to the supply roller, i.e., compared to the amount of developer drawn up. The results are shown in FIG. 17, and indicate that the screw pipe treated by a blasting process on the exterior surface was able to draw up more developer compared to the unprocessed screw pipe. When the ability to draw up developer was excellent, developer transportability in the axial direction was reduced, but this problem is adequately corrected by providing a plurality of ribs having minimal pitch on the exterior side of the screw pipe to balance the developer transporting forces on the outside and inside of the screw pipe.

As can be clearly understood from the preceding description, in the developer mixing/transporting device of the present invention, the rotatably driven cylindrical developer transport path rapidly transports developer in predetermined directions via the transport force imparted by a first transport means because the interior surface of the developer transport path has a friction coefficient that is less than the friction coefficient of the exterior surface. On the other hand, suitable transportability is obtained not only in an axial direction by a second transporting means, but also in a circumferential direction by the friction coefficient of the exterior surface of the transport path because the exterior surface of the cylindrical developer transport path has a large friction coefficient.

Accordingly, developer circulation, developer pick-up, and developer supply characteristics are excellent, and when copying images in which large amounts of developer are consumed, the images are reproduced with suitable image density. Furthermore, stress on the developer is reduced, thereby prolonging the service life of the developer.

7) Toner Replenishment Control

Figure 18:
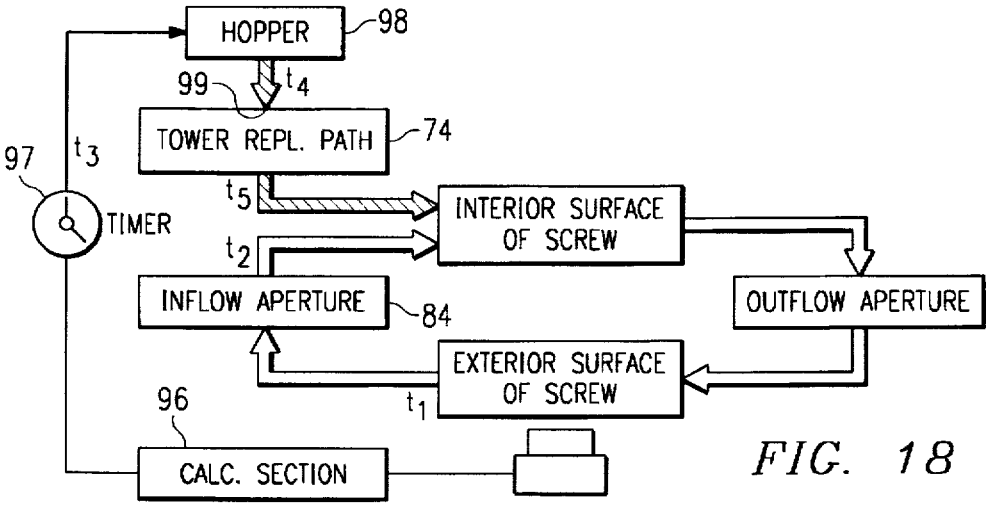
FIG. 18 is an illustration showing the timing for toner replenishment of the developing device of FIG. 2.

Control of toner replenishment to developing devices 11, 12, 13, 14 is described hereinafter with reference to FIG. 18. Developing devices 11, 12, 13, 14 are provided with toner density sensors 95 at the bottom of their respective housings 34 at a position confronting mixing screw 51 as shown in FIGS. 2 and 11. Toner density, i.e., the weight-mix ratio of toner contained in the developer, detected by the toner density sensor 95 is output to calculation section 96. Calculation section 96 determines whether or not the toner density is suitable. If toner density is determined to be insufficient, the amount of toner to be replenished is calculated, and toner replenishment signals are output to hopper 98. Toner transported from hopper 98 is introduced into toner replenishment path 74 through toner replenishment aperture 99 (see FIG. 11), and delivered into screw pipe 87 where it is mixed with the developer via the transport action of replenishment blade 76 in accordance with the rotation of rotating shaft 60.

Freshly replenished toner must be resupplied to developer detected as having a low toner density by toner density sensor 95. The time from when toner density is detected by toner density sensor 95 until the toner transported from hopper 98 is mixed with the developer, i.e., the total time comprising time t3 from the time of the detection of toner density by sensor 95 until hopper 98 is actuated, time t4 until developer transported from hopper 98 reaches toner replenishment aperture 99, and time t5 until toner introduced in toner replenishment aperture 99 passes through toner replenishment path 74 and is delivered inside screw pipe 87, must be equal to the time it takes the developer that has passed the portion confronting toner density sensor 95 to reach the toner replenishment position, i.e., the total time comprising time t1 required for the developer that has passed over sensor 95 to reach inflow aperture 84, and time t2 required for the developer passing through inflow aperture 84 to fall into screw pipe 87. In the respective developing devices 11, 12, 13 and 14, timer 97 is set for a time t3 from the detection of toner density by sensor 95 until hopper 98 is actuated, and hopper 98 is actuated when the delay of time t3 has elapsed, so as to replenish toner to the developer detected as having low toner density.

8) Embodiment 2

Figure 19:
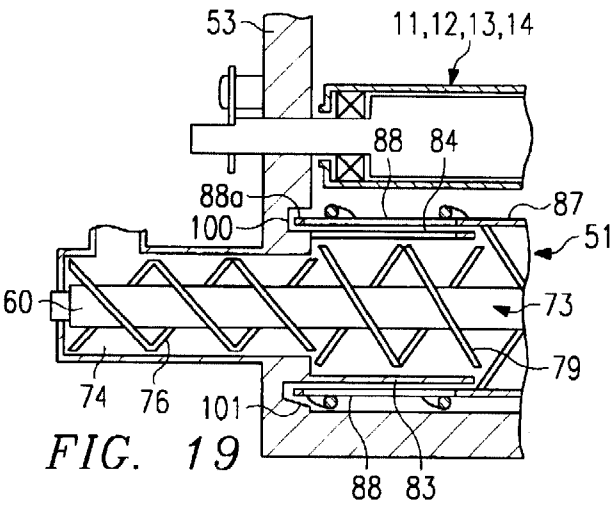
FIG. 19 is a partial section view of a developing device according to a second embodiment of the invention.

FIG. 19 shows a second embodiment of a developing device according to the present invention. In the embodiment of FIG. 19, a circular channel 100 which is centered on rotating shaft 60 is formed on housing side wall 53 relative to the end of screw pipe 87, and the bottom 101 of the channel 100 is inclined downwardly in a direction toward the interior of the housing. Screw pipe 87 protrudes into channel 100, and the exterior edge 88*a* of inflow aperture 88 is enlarged to extend into the interior side of channel 100. The exterior edge of inflow aperture 84 of inflow pipe 83 coincides with the interior surface of housing side wall 53.

By means of the aforesaid construction, the widths of aperture 88 and inflow aperture 84 are widened, such that developer transported along the exterior of screw pipe 87 readily flows into screw pipe 87 through aperture 88 and inflow aperture 84, thereby increasing the speed of circulation of the developer. Developer entering channel 100 flows out along the inclined surface of channel bottom 101. Accordingly, developer collects between screw pipe 87 and housing side wall 53, and the collected developer does not solidify. Although not shown in FIG. 19, the opposite side of mixing screw 51, i.e., the outflow side, may be identically constructed.

9) Embodiment 3

Figure 20:
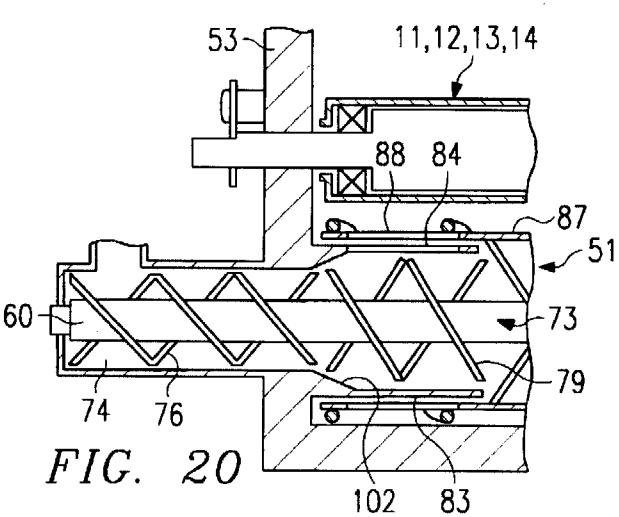
FIG. 20 is a partial section view of a developing device according a third embodiment of the invention.

FIG. 20 shows a third embodiment of a developing device according to the present invention. In the third embodiment, the end of inflow pipe 83 connected to housing side wall 53 has a tapered surface 102 formed on the interior side thereof. Transport blade 79 has an external dieter determined so as to define a predetermined spacing with tapered surface 102.

By means of the aforesaid construction, toner resupplied to toner replenishment path 74 is rapidly introduced into inflow pipe 83 and is mixed with developer. Toner and developer collect between inflow pipe 83 and toner replenishment path 74 and do not solidify, thereby allowing easy cleaning when developer is replaced.

10) Embodiment 4

Figure 21:
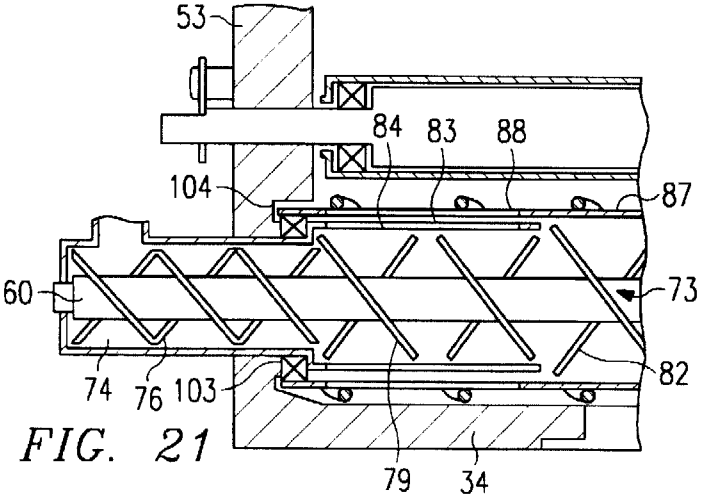
FIG. 21 is a partial section view of a developing device according a fourth embodiment of the invention.

FIG. 21 shows a fourth embodiment of a developing device according to the present invention. In the fourth embodiment, inflow pipe 83 is integratedly connected to toner replenishment path 74. Screw pipe 87 is separated from transport blade rotate 82 and is supported to rotate freely by a bearing 103 arranged on the surface of toner replenishment path 74. Bearing 103 and the end of screw pipe 87 are arranged in a channel 104 formed in housing side wall 53. Although the other end of screw pipe 87 is not illustrated, screw pipe 87 is supported by a bearing sheathing rotating shaft 60, and is connected to a drive system different from that of rotating shaft 60, so as to be rotatably driven at a rotational speed different from that of rotating shaft 60, but in the same direction therewith.

By means of the aforesaid construction, the developer transport speeds inside and outside screw pipe 87 are freely selectable. There is no collection and solidification of developer at the perimeter of bearing 103 because the bearing 103 is housed in channel 104 of housing side wall 53. In the embodiment, bearing 103 is the periphery of toner replenishment path 74, and is provided adjacent to a connection with toner inflow pipe 83 which has a larger dieter, such that it is difficult for developer to be introduced into bearing 103, thereby preventing adhesion of solidified developer thereon.

11) Embodiment 5

Figure 22:
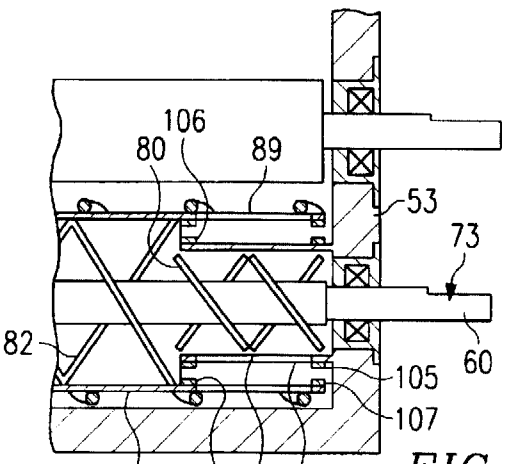
FIG. 22 is a section view of a developing device according to a fifth embodiment of the invention.

FIG. 22 shows a fifth embodiment of a developing device according to the present invention. In the fifth embodiment, developer outflow pipe 85 has magnet members 105 and 106 adhered at the peripheral leading edge and the housing side wall edge of outflow aperture 86 so as to circumscribe the aperture. On the other hand, magnet members 107 and 108 are adhered on the interior surface of screw pipe 87 opposite magnet members 105 and 106 in a state of non-contact therewith such that the regions of confrontation of opposed magnet members 105 and 107 and opposed magnet members 106 and 108 are magnetized with respectively different polarities. Accordingly, a magnetic brush is formed by developer between the magnet members via the magnetic fields formed between opposed magnet members 105 and 107 and opposed magnet members 106 and 108, such that introduction of developer between screw pipe 87 and outflow pipe 85 is prevented, thereby assuring smooth rotation of screw pipe 87.

12) Embodiment 6

FIG. 23 shows a modification of screw pipe 87 according to a sixth embodiment of the present invention wherein a brush 109 is disposed at the regions facing inflow pipe 83 and outflow pipe 84 and the periphery thereof at bilateral ends of the screw pipe 87, such that the bristles of the brush 109 come into contact with the exterior surfaces of pipes 83 and 84. Thus, developer flowing from outside the screw pipe through aperture 86 falls inside inflow pipe 83 through inflow aperture 84 and is not introduced into a space between screw pipe 87 and inflow pipe 83. Developer flowing out from outflow aperture 86 of outflow pipe 84 is discharged outside screw pipe 87 through aperture 89 and is not introduced into a space between screw pipe 87 and outflow pipe 84. Accordingly, developer circulation is improved. Furthermore, toner resupplied through toner replenishment path 74 does not flow from the space between screw pipe 87 and inflow pipe 83 to the outside of screw pipe 87, such that replenished toner is reliably mixed with the developer.

It is desirable that the length of brush 109 be such that the follicles thereof come somewhat into contact with the exterior surface of pipes 83 and 84, so as to suppress the minimum limit of wear to the brush and wear on the pipe, thereby minimizing stress on the developer.

13) Embodiment 7

The previously described copier is provided with four developing devices 11, 12, 13, 14 of identical construction. In developing devices 11, 12, 13 and 14, mixing screw 51 transports developer within screw pipe 87 from a near end to a far end, and transports developer outside screw pipe 87 from a far end to a near end, such that the developer transport operation is accomplished in transport paths on the same axis, without affecting developer transportability even when the angles of the developing devices 11, 12, 13, 14 relative to photosensitive member 9 are different. However, inflow aperture 84 and outflow aperture 86 in the developing devices are such that developer lifted against gravity passes through inflow aperture 84 and outflow aperture 86 in accordance with the force of gravity, and the inflow aperture 84 and the outflow aperture 86 must be adjusted for each developing device so as to face a predetermined uniform direction, as shown in FIGS. 24 and 25.

Figure 26:
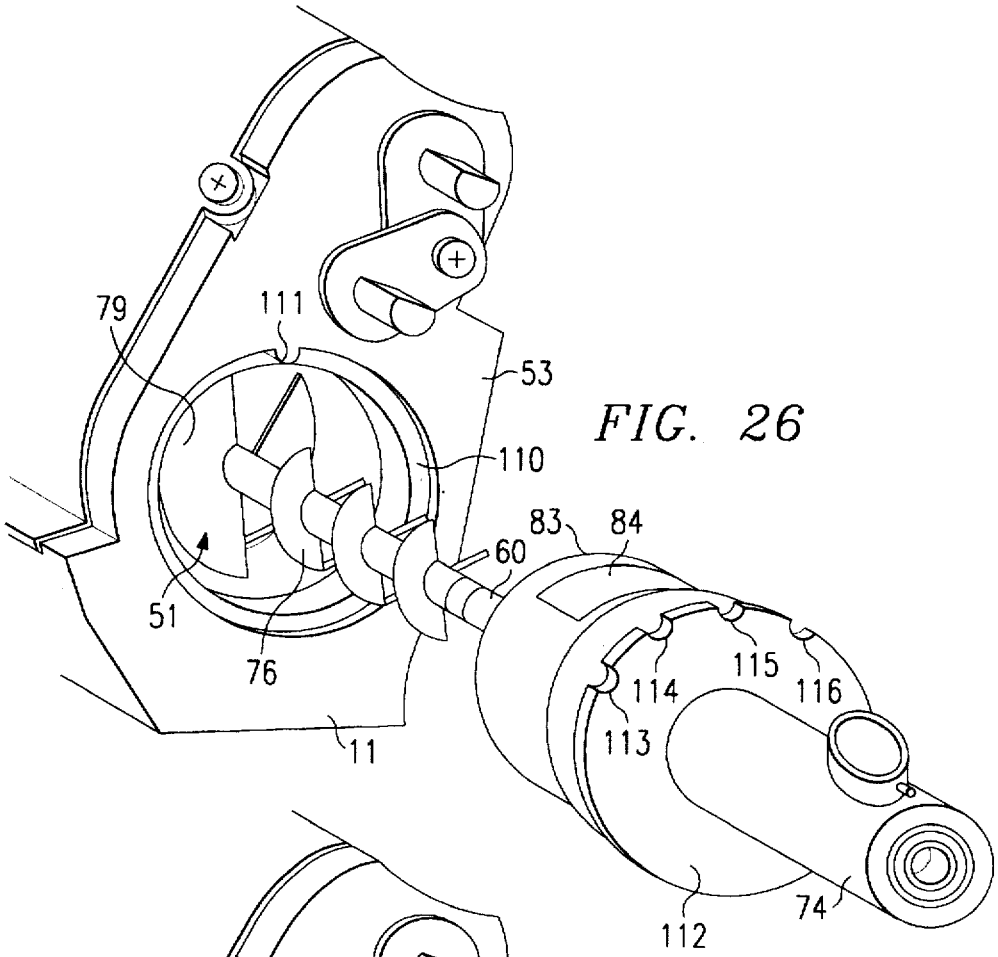
FIG. 26 shows a mechanism for arranging the inflow apertures of each developing device according to a seventh embodiment of the invention.

In the seventh embodiment of the present invention, as shown in FIG. 26, a round aperture 110 is formed in housing side wall 53 in the portion facing inflow pipe 83; and a positioning protrusion 111 is formed so as to protrude toward the aperture 110. On the other hand, a ring-shaped cover 112 which engages aperture 110, and a toner replenishment path 74 which protrudes from cover 112 are integratedly formed on inflow pipe 83. Positioning grooves 113, 114, 115 and 116 which can engage the protrusion 111 are formed on cover 112 at different positions corresponding to the different set angles of developing devices 11, 12, 13, 14 relative to photosensitive member 9.

According to the above-described construction, inflow pipe 83, cover 112, and toner replenishment path 74 sheath mixing screw 51 from one end, transporting blade 79 is covered by inflow pipe 83, toner replenishment blade 76 is covered by toner replenishment path 74, and cover 112 engages aperture 110. At this time, in developing device 11, groove 113 engages protrusion 111; and in developing devices 12, 13 and 14, the respective grooves 114, 115 and 116 engage protrusions 111. Thus, in developing devices 11, 12, 13 and 14, inflow apertures 84 of inflow pipes 83 face the same direction, i.e., are positioned as shown in FIG. 24.

14) Embodiment 8

Figure 27:
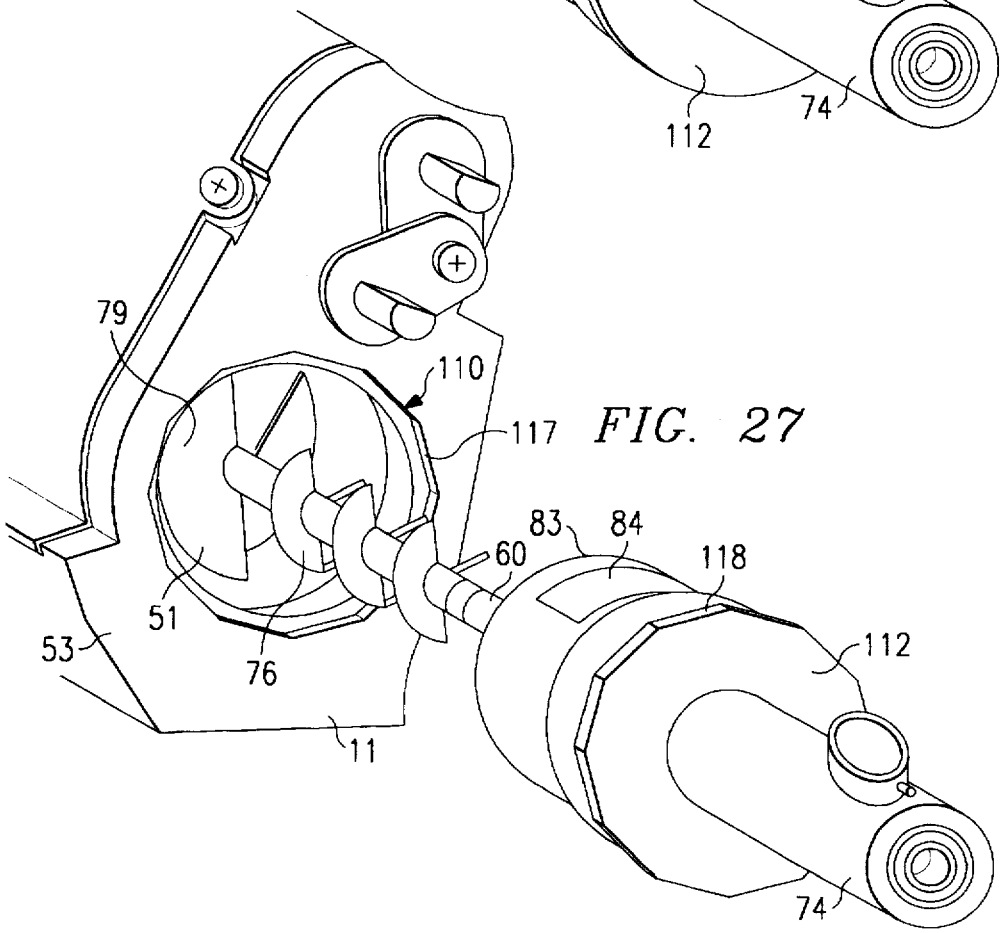
FIG. 27 shows a mechanism for arranging the inflow apertures of each developing device according to an eighth embodiment of the present invention.

In the seventh embodiment, protrusion 111 is provided on aperture 110 of housing side wall 53; and four grooves 113, 114, 115 and 116 are provided on cover 112 which covers the aperture 110. However, in the eighth embodiment of the present invention as shown in FIG. 27, the internal periphery of aperture 110 is formed in a polygonal shape corresponding to set angles of developing devices 11, 12, 13, 14, and the exterior periphery of cover 112 is formed in a polygonal shape corresponding to polygonal shape 117. In this embodiment, inflow apertures 84 of inflow pipes 83 may face the same direction, as shown in FIG. 24, by utilizing a different set angle of cover 118 for each developing device.

15) Embodiment 9

Figure 28:
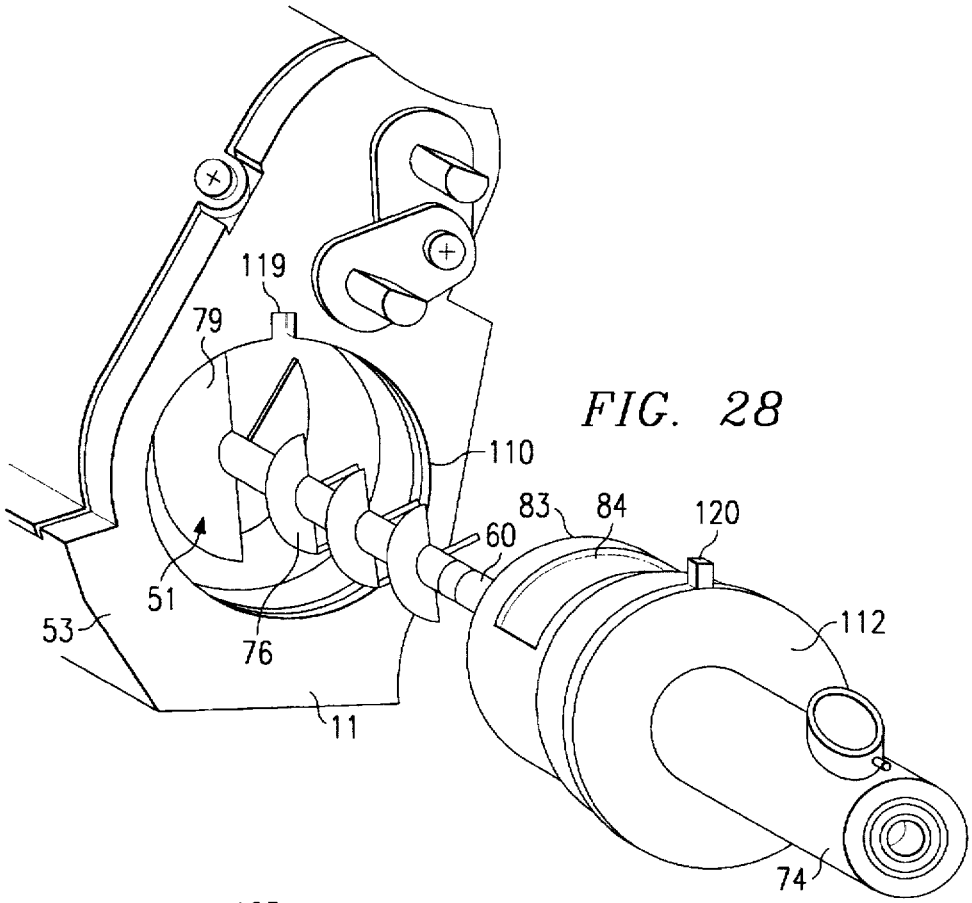
FIG. 28 shows a mechanism for arranging the inflow apertures of each developing device according to a ninth embodiment of the present invention.

Instead of the arrangements described in the seventh and eighth embodiments, the ninth embodiment of the present invention, shown in FIG. 28, provides a notch 119 in aperture 110 of housing side wall 53 at a different position for each developing device; and a protrusion 120 is provided on cover 112 to engage notch 119. Notch 119 is provided at a number of locations, i.e., at four locations in the present embodiment. Protrusion 120 engages the notch corresponding to the particular developing device.

16) Embodiment 10

Figure 29:
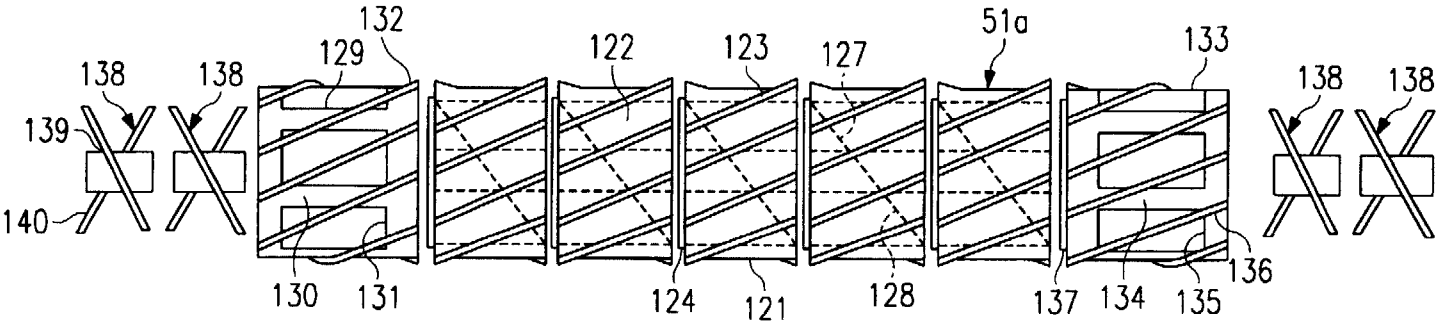
FIG. 29 is an exploded view showing a mixing screw according to a tenth embodiment of the present invention.

FIG. 29 shows a further embodiment of a mixing screw according to the present invention. Mixing screw 51a comprises a plurality of screw blocks 121, an inflow block 129 connected to one end of the screw blocks 121, an outflow block 133 connected to the other end of the screw blocks 121, and a plurality of bottle blocks 138 arranged inside the inflow and outflow blocks 129 and 133.

Figure 30:
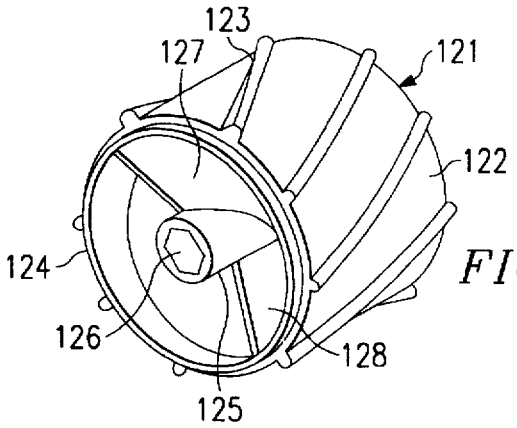
FIG. 30 is a perspective view of a screw block incorporated in the mixing screw of FIG. 29.

Screw blocks 121 are integratedly formed by injection melding. As shown in detail in FIG. 30, screw block 121 comprises a cylinder 122 having a plurality of spiral-shaped ribs 123 on the exterior surface thereof. Around the opening at one end of cylinder 122, the exterior diameter of the leading edge forms a connector 124 which is smaller than the exterior diameter of cylindrical portion 122; and the opening at the other end of a facing cylinder 122, is formed with a step (not illustrated) which engages connector 124. The interior side of cylinder 122 is provided with a concentric shaft 125 having an hexagonal-shaped through hole 126. The cylinder 122 and the shaft 125 are integratedly connected by two transport blades 127 and 128 which are mounted at different angles on shaft 125.

Inflow block 129 is also integratedly formed by injection molding, and a plurality of apertures 131 are formed on the exterior side of inflow block cylinder 130. On the end of cylinder 130 connected to screw block 121, a step (not illustrated) is formed which engages the aforesaid connector 124 on the screw block.

Outflow block 133 is also integratedly formed by injection molding, and a plurality of apertures 135 are formed on outflow block cylinder 134. A plurality of spiral-shaped ribs 136 are provided on the exterior side of cylinder 134. On the end of cylinder 134 connected to screw block 121, a connector 137 is formed which engages the previously mentioned step on screw block 121. Inflow block 129 and outflow block 133 are both provided with a connector at the opening at one end thereof, so as to be commonly joined by the step provided at the opening at the other end thereof which engages the connector.

Bottle blocks 138 are also integratedly formed by injection molding, and are each provided with two blades 140 disposed at different angles on cylindrical shafts 139 thereof which have an hexagonal-shaped through hole.

A plurality of screw blocks 121 have a connector 124 at one end which engages a step at the other end of another facing screw block 121, such that the spiral-shaped ribs 123 thereon are continuous. The step end of inflow block 129 engages and connects with connector 124 of the adjacent facing screw block 121. Outflow block 133 has a connector 137 at one end which engages and connects with the step of the adjacent screw block 121. Bottle blocks 138 are installed inside inflow block 129 and outflow block 133. An hexagonal rotating shaft (not illustrated) is inserted through the through holes of bottle blocks 138 and through holes 126 of screw blocks 121, so as to integrate screw blocks 121, inflow block 129, outflow block 133, and bottle blocks 138 to form mixing screw **51*a*. Accordingly, mixing screw 51*a*** is advantageous inasmuch as its length may be freely adjusted in accordance with the size of the developing device.

17) Embodiments 11a, 11b and 11c

Figure 31:
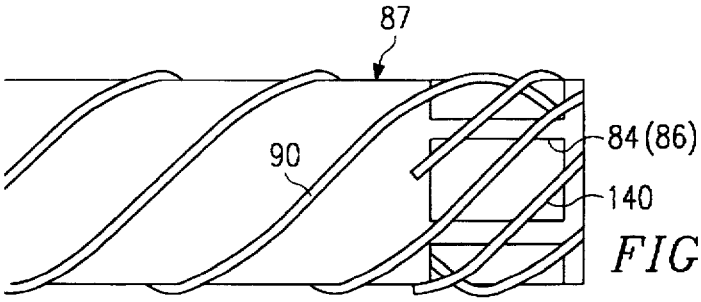
FIG. 31 is a front view showing an improvement of the ends of the screw pipe of the mixing screw of FIG. 29.
Figure 33:
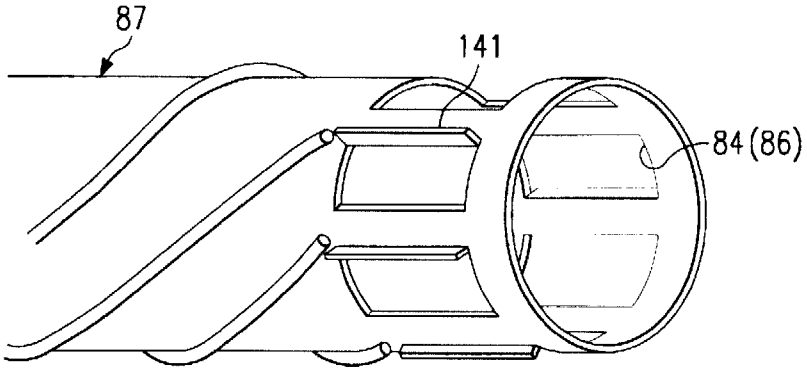
FIG. 33 is a front view showing yet another improvement of the ends of the screw pipe.
Figure 32:
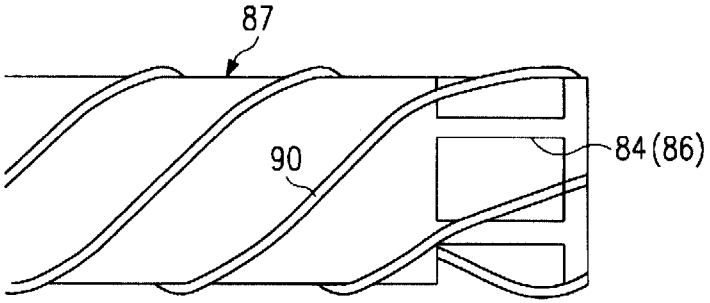
FIG. 32 is a front view showing another improvement of the ends of the screw pipe.
Figure 39:
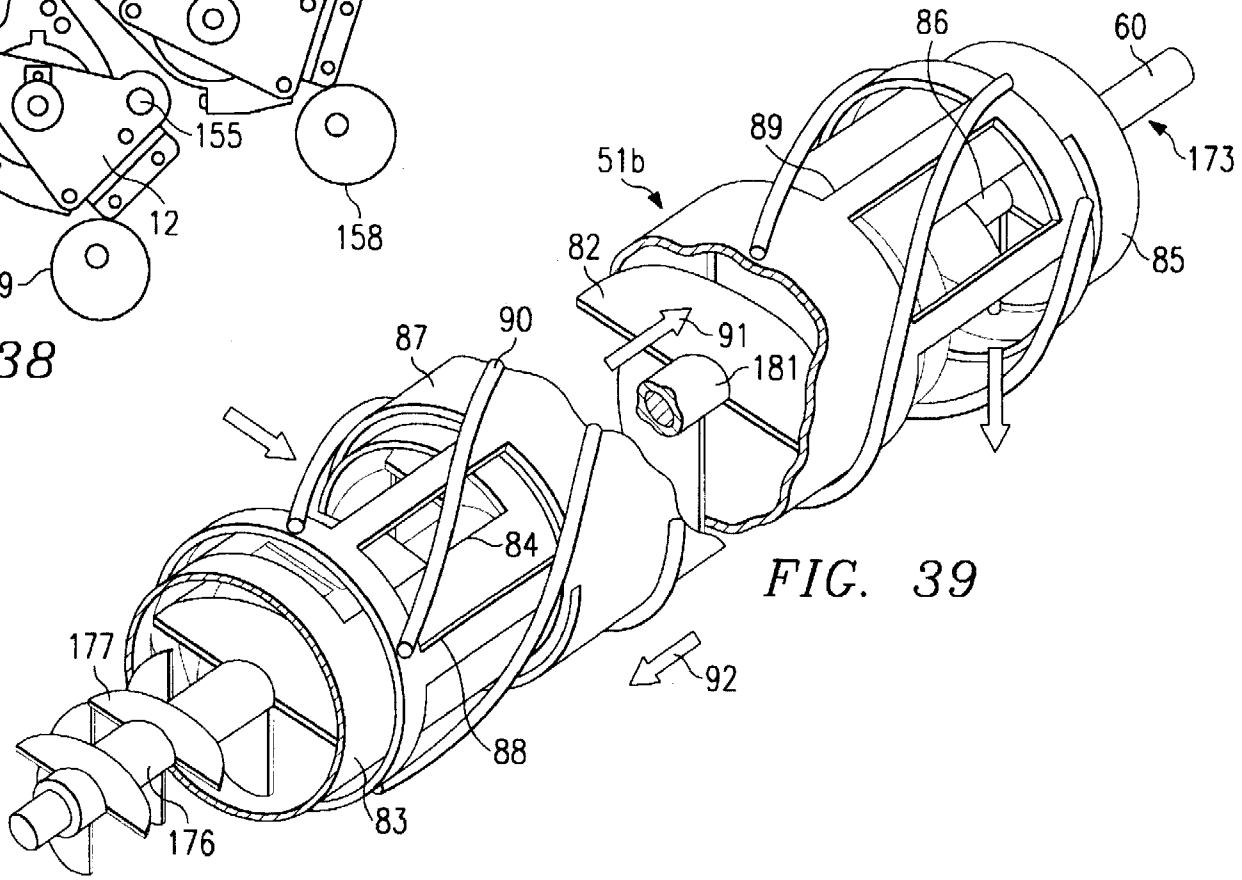
FIG. 39 illustrates a mixing screw according to a sixteenth embodiment of the present invention.

When developer flows into inflow pipe 83 at the end of the previously described screw pipe 87, it is necessary that the size of apertures 84 and 86 be as large as possible so as to prevent developer from flowing out from outflow pipe 85. However, when apertures 84 and 86 are large, the ability to draw up developer is reduced, thereby reducing image density at positions corresponding to apertures 84 and 86. In the embodiment of screw pipe 87 shown in FIG. 31, a plurality of spiral-shaped ribs 140 are provided on the circumference of apertures 84 and 86 to increase the ability to draw up developer in the vicinity of apertures 84 and 86. In the embodiment shown in FIG. 32, the angle of inclination of ribs 90 positioned on the circumference of apertures 84 and 86 is lessened, and in the embodiment shown in FIG. 33, extension blades 141 protruding outwardly are provided along the edges of apertures 84 and 86 on the downstream side in the direction of rotation.

18) Embodiment 12

Figure 34:
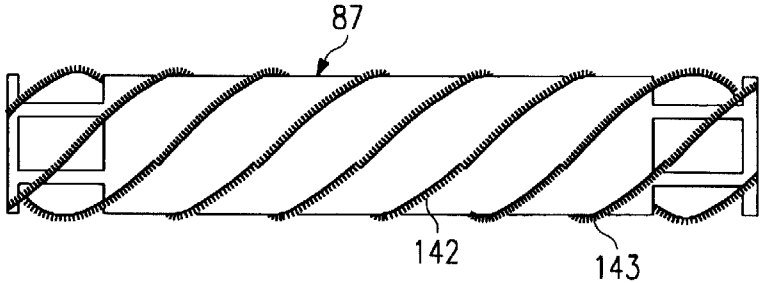
FIG. 34 is a front view showing an improvement of ribs provided on the exterior surface of the screw pipe according to a twelfth embodiment of the present invention.

FIG. 34 shows yet another embodiment of the ribs provided on the exterior surface of screw pipe 87. These ribs comprise a coil spring 142 formed by a plurality of twisted fine metal wires having a brush 143 disposed therebetween. According to this embodiment, developer positioned between screw pipe 87 and housing 34 is reliably lifted by brush 143, and supplied to supply roller 46 thereabove.

19) Embodiment 13

FIG. 35 shows still another embodiment of a screw pipe. In screw pipe 144, exterior ribs 145 are integratedly formed. The mixing screw is constructed of screw pipe 144 with transport blades 82 anchored to its surface.

20) Embodiment 14

FIGS. 36 and 37 show an alternative embodiment of the construction of the connection of the screw pipes and transport blades in the mixing screw. In this embodiment, a protrusion 149 is integratedly formed on the surface 148 of a transport blade 147, i.e., the surface of blade 147 on the side opposite the surface in contact with the developer and applying a transport force thereto, at one end of rotating shaft 146. Transport blade 147, when viewed from the extension line from rotating shaft 146, is formed so as to circle the edge of the exterior surface. Through hole 150 is formed through protrusion 149 from the exterior surface to rotating shaft 146. Screw pipe 151 is a cylindrical member having an internal diameter equal to the external diameter of transport blade 147, and has a through hole 152. Screw pipe 151 which sheaths the surface of transport blade 147 is integratedly formed such that screw 153 is screwed into the through holes 152 and 150.

In the mixing screw having the aforesaid construction, screw pipe 151 and screw 153 are formed of electrically conductive metal, and when an electrically conductive metal shaft is inserted inside rotating shaft 146, an electrical current can pass through the metal shaft and the exterior surface of screw pipe 151 via screw 153. If the metal shaft is grounded, screw pipe 151 may also be grounded. Therefore, in a device for optically detecting toner density through a transparent detection window facing screw pipe 151, a bias voltage may be applied to prevent soiling of the detection window. In such circumstances, when the facing screw pipe 151 is grounded, an electric field is formed between the detection window and the screw pipe 151, thereby preventing toner adhesion on the detection window.

21) Embodiment 15

Figure 38:
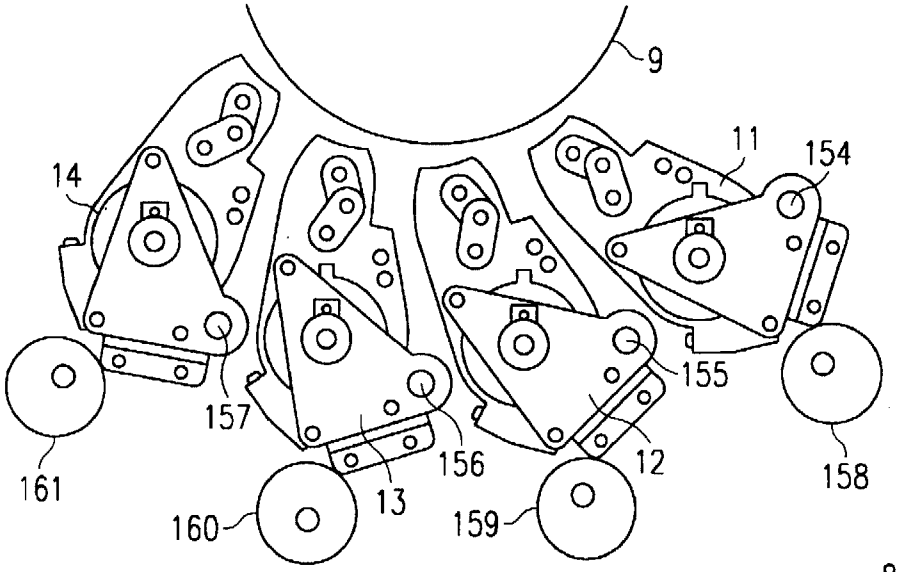
FIG. 38 shows a mechanism for switching a developing device between a developing state and a non-developing state according to a fifteenth embodiment of the present invention.
Figure 40:
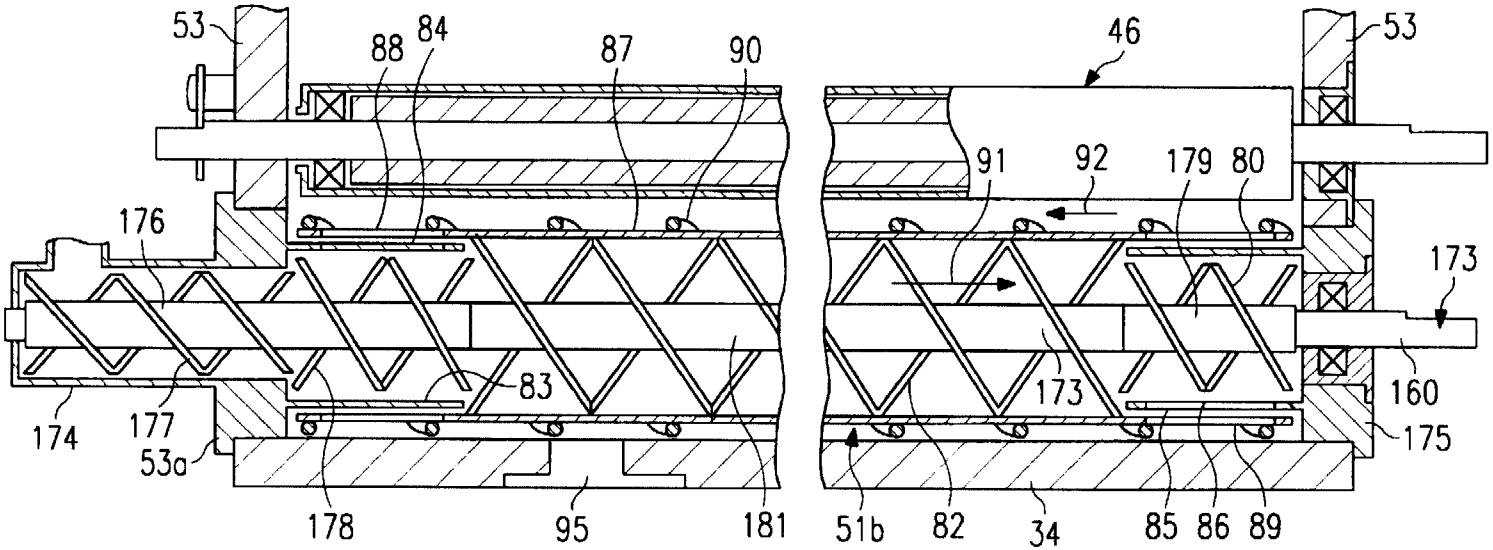
FIG. 40 is a section view of a developing device incorporating the mixing screw of FIG. 39.
Figure 41:
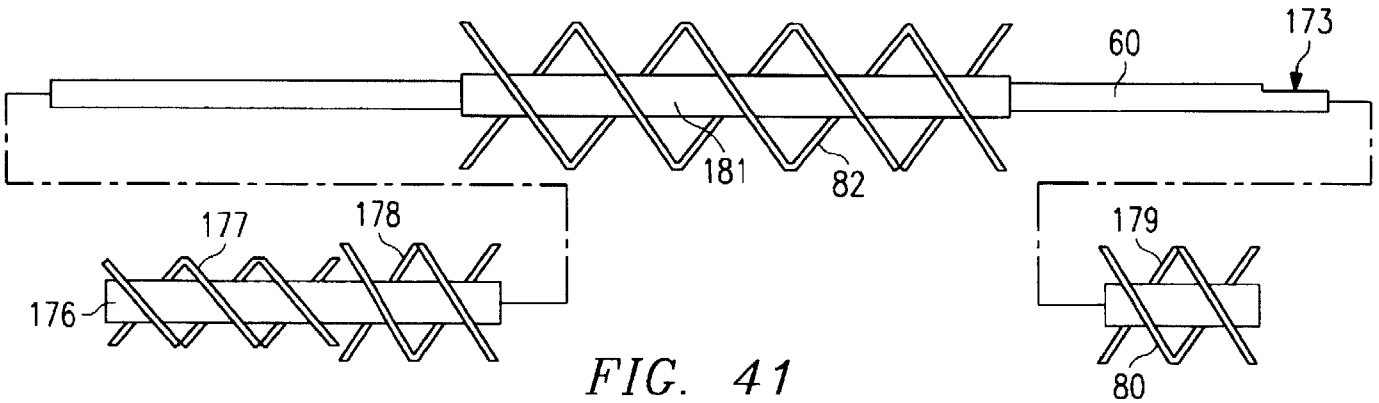
FIG. 41 is an exploded view showing components of the mixing screw of FIG. 39.

Although the first embodiment described above was described in terms of switching developing devices 11, 12, 13, 14 between a developing state and a non-developing state by controlling the rotation of supply roller 46, it is to be noted that developing devices 11, 12, 13 14 may also be switched between a developing state and a non-developing state by supporting developing devices 11, 12, 13, 14 so as to be rotatable, i.e., retractable, from photosensitive member 9 by shafts 154, 155, 156, 157, and developing devices 11, 12, 13, 14 may be retracted from photosensitive member 9 based on the rotation of eccentric cams 158, 159, 160, 161 as illustrated in FIG. 38.

22) Embodiment 16

FIGS. 39–45 show a mixing screw according to yet a further embodiment of the present invention. In FIGS. 39–45, the mixing screw, designated by reference number **51*b*, is similar in many respects to the embodiment described with reference to FIGS. 10–12, and only the different features thereof will be described in detail herein. Specifically, in this embodiment, one end (left side of FIG. 40) of rotating shaft 60 is arranged in a toner replenishment path unit 174, which is integral with side wall portion 53*a*, so as to be removable from side wall 53 of housing 34. Specifically, the end of the shaft protrudes from housing side wall 53 in a removable manner, and is supported at the end of toner replenishment path unit 174 so as to be freely rotatable. The other end (right side of FIG. 40) of rotating shaft 60 is supported so as to be freely rotatable on a bearing member 175 removably provided on housing side wall 53**.

Figure 43:
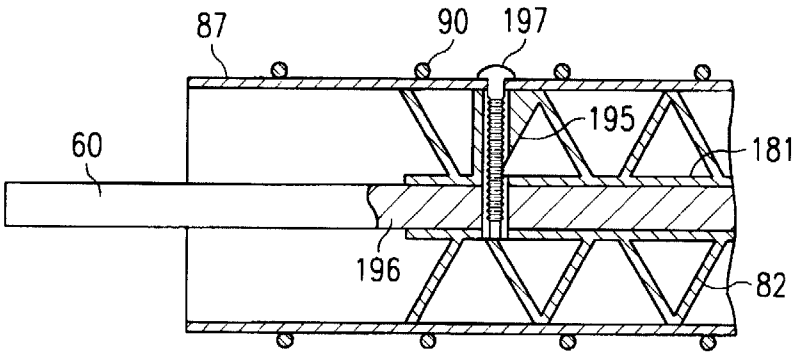
FIG. 43 is a partial section view of the mixing screw of FIG. 39 showing another method of screw pipe attachment.
Figure 42:
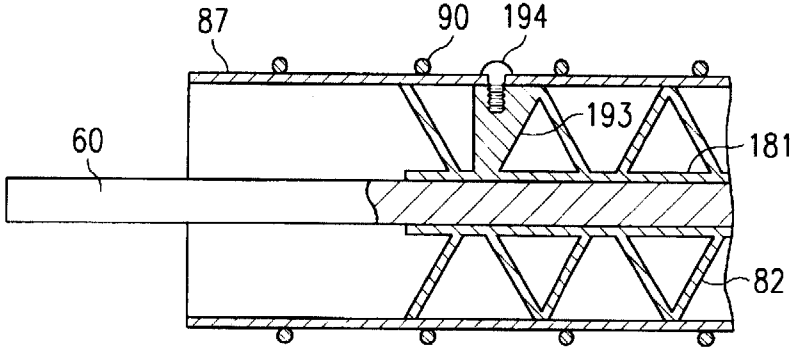
FIG. 42 is a partial section view of the mixing screw of FIG. 39 showing a method of screw pipe attachment.

Mounting of screw pipe 87 may be accomplished, for example, by providing a screw mounting 193 integrated with transport blade 82 of a center screw portion 181 such that mounting 193 and screw pipe 87 are fixedly attached by a screw 194, as shown in FIG. 42, or a screw 197 may be screwed through screw pipe 87 into a screw hole 196 provided through rotating shaft 60 and screw mounting 195 provided on center screw 181 as shown in FIG. 43.

Figure 44:
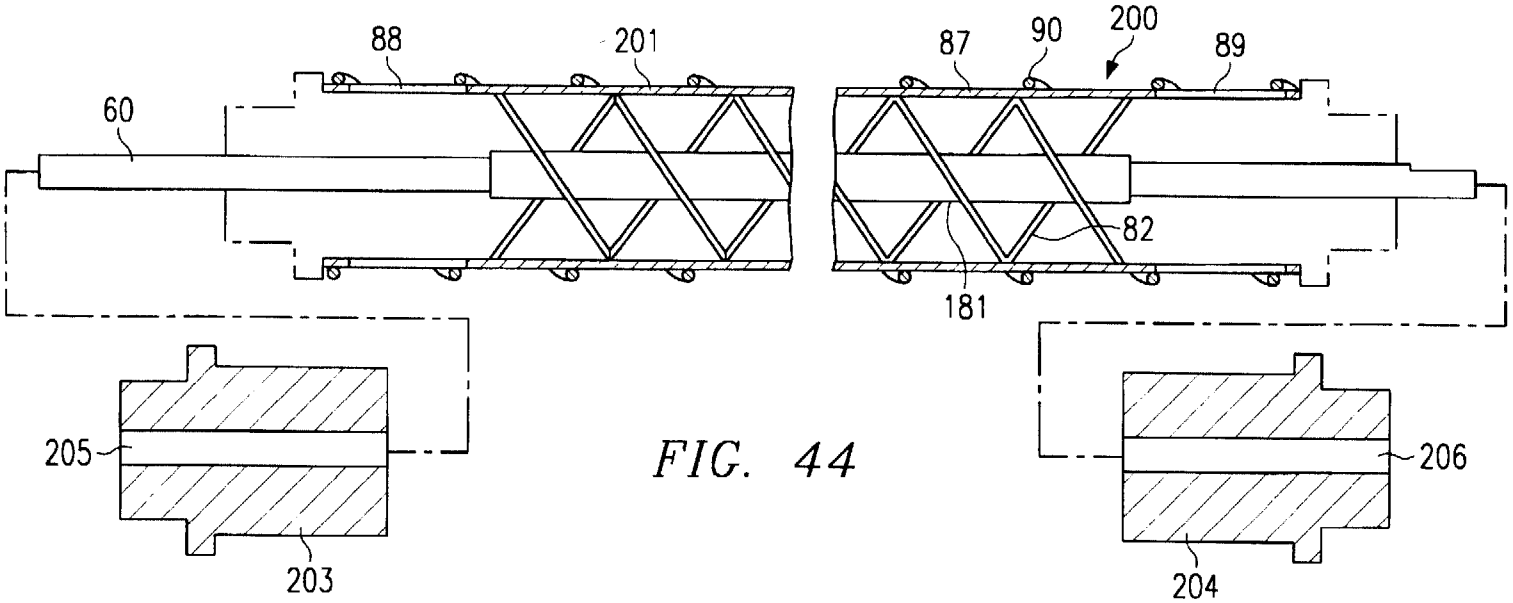
FIG. 44 is an exploded section view of a screw cartridge with the caps removed.

Replacement of developer in a developing device as described above is described hereinafter with reference to FIGS. 44 and 45. Loading of developer in a developing device is accomplished using screw cartridge 200 shown in FIG. 44. Screw cartridge 200 comprises a cartridge body 201 from which inflow screw 176 and outflow screw 179 have been removed from bilateral ends of rotating shaft 60 of mixing screw **51*b* (see FIG. 41), and caps 203 and 204 which removably engage the openings of bilateral ends of screw pipe 87 which comprises cartridge body 201, the caps 203 and 204 being inserted on rotating shaft 60 via through holes 205 and 206. Caps 203 and 204, when engaged with screw pipe 87, are of a length sufficient to cover bilateral apertures 88 and 89. When either cap 203 or cap 204 is removed from screw cartridge 200**, developer or starter (initial developer, i.e., developer loaded at the factory prior to shipping) may be loaded.

Figure 45:
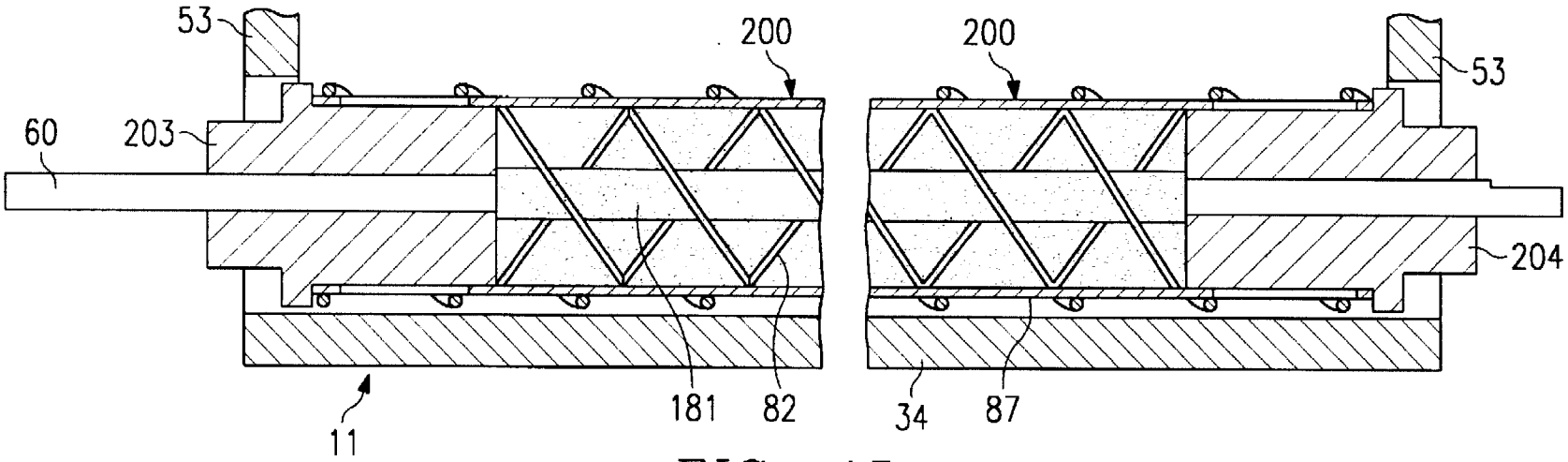
FIG. 45 is a section view of a screw cartridge installed in a developing device.

When screw cartridge 200 loaded with starter is installed in a developing device, screw cartridge 200 is inserted into a developing device from which toner replenishment path unit 174 and bearing 175 have been removed, as shown in FIG. 45. Then, caps 203 and 204 are removed, and inflow screw 176 and outflow screw 179 at both ends of rotating shaft 60 are installed, toner replenishment path unit 174 and bearing 175 are again installed on housing 34 so as to support bilateral ends of rotating shaft 60.

When replacing developer in a developing device, the developing devices are actuated to allow developer to drop through developer aperture 295 provided on the bottom of housing 34 for collection. Then, the various drive rollers and clutches are removed from the side wall. Then, toner replenishment path unit 174 and bearing 175 are removed from housing side wall 53. Finally, inflow screw 176 and outflow screw 179 are removed. Caps 203 and 204 are removed from the new screw cartridge 200, and mounted on both ends of replenishment screw **51*b* being replaced in the developing device so as to prevent developer adhering to the interior of replenishment screw 51*b* from falling out, and the replenishment screw 51*b* is then removed from the developing device. Developer remaining inside housing 34 is removed as necessary. The new screw cartridge 200 loaded with developer is then installed in housing 34, and the inflow screw 176 and outflow screw 179 of the previously removed mixing screw 51*b* are respectively mounted at bilateral ends of the installed screw cartridge 200, and toner replenishment path unit 174 and bearing 175 are mounted to housing side wall 53 so as to support rotating shaft 60**.

Developer may be loaded and collected inside replenishment screw **51*b* without allowing the developer in the developing device to drop for collection. In such a circumstance, after bearing 175 is removed from housing 34, outflow screw 179 is removed from rotating shaft 60. Cap 204 is engaged with the end of replenishment screw 51*b* instead of screw 179. Bearing 175 is then mounted on housing 34, and mixing screw 51*b* and the like is actuated. Thus, developer is loaded into replenishment screw 51*b*. Thereafter, toner replenishment path unit 174 and bearing 175 are removed, inflow screw 176 is removed, cap 203 is engaged with the inflow side of replenishment screw 51*b*, and replenishment screw 51*b*** loaded with developer is removed from the developing device. Thereafter, the operation is identical to that of the previously described developer replacement process.

As can be clearly understood from the preceding description, the invention according to the embodiment of FIGS. 39–45 uses a developer mixing member installed in a developing device as a developer accommodating device, thereby allowing new developer to be loaded in a developing device via a simple operation of simply installing the developer mixing member in a developing device and removing the caps. Accordingly, the time required for developer replacement in developing devices is reduced even in full color copiers and the like which have many developing devices. Furthermore, since developer can be removed while contained within the developer mixing member during developer replacement, very little developer remains in the developing device when the developer mixing member is removed, and any such residual developer can be easily collected thereafter, thereby minimizing airborne scattering of developer in the vicinity.

We claim:

1. A developer transporting device comprising:

a pair of walls;

a rotating shaft supported between the pair of walls;

a first transporting member provided on the rotating shaft;

a rotating cylindrical screw concentrically sheathing the rotating shaft and having a second transporting member provided on an exterior surface thereof, said rotating cylindrical screw also having apertures provided at both ends thereof in the circumferential direction;

an inflow pipe fixedly mounted on one wall of the pair of walls and extending into one end of the cylindrical screw and provided with a developer inflow opening at a top region facing an aperture of the apertures provided in the cylindrical screw; and an outflow pipe fixedly mounted on the other wall of the pair of walls and extending into the other end of the cylindrical screw and provided with a developer outflow opening at a bottom region facing an aperture of the apertures provided in the cylindrical screw.

2. A developer transporting device as claimed in claim 1 wherein the first transporting member comprises a blade which is provided obliquely on the shaft.

3. A developer transporting device as claimed in claim 1 wherein the second transporting member comprises a spiral-shaped rib.

4. A developer transporting device as claimed in claim 1 wherein the rotating cylindrical screw extends into a circular channel provided in at least one of the pair of walls.

5. A developer transporting device as claimed in claim 4 wherein the circular channel has an inclined surface.

6. A developer transporting device as claimed in claim 1 wherein an interior surface of the inflow pipe has a tapered face at a location confronting the inflow opening.

7. A developer transporting device as claimed in claim 1 further comprising a bearing which is positioned between an outer surface of the inflow pipe and an inner surface of the cylindrical screw for supporting said cylindrical screw.

8. A developer transporting device as claimed in claim 1 further comprising means for generating a magnetic field between an outer surface of the outflow pipe and an inner surface of the cylindrical screw for preventing introduction of developer therebetween.

9. A developer transporting device as claimed in claim 1 further comprising a brush provided on an inner surface of the rotating cylindrical screw.

10. A developer transporting device as claimed in claim 1 further comprising means for adjusting the position of said inflow opening and said outflow opening to face predetermined directions.

11. A developer transporting device as claimed in claim 10 wherein said adjusting means includes first positioning means on each of said inflow pipe and said outflow pipe and second positioning means on each of said pair of walls, said first and second positioning means being selectively engagable with one another to position said inflow opening and said outflow opening to face predetermined directions.

12. A developer transporting device as claimed in claim 11 wherein said first positioning means includes a plurality of spaced grooves and said second positioning means includes a protrusion, said protrusion being selectively receivable in any one of said plurality of spaced grooves to position said inflow opening and said outflow opening to face predetermined directions.

13. A developer transporting device as claimed in claim 11 wherein said first positioning means comprises a polygonal-shaped cover member and said second positioning means comprises a polygonal-shaped opening in said walls, said polygonal-shaped cover member being receivable within said polygonal-shaped opening at any of a plurality of angular orientations to position said inflow opening and said outflow opening to face predetermined directions.

14. A developer transporting device as claimed in claim 1 wherein said rotating cylindrical screw comprises a plurality of blocks, each of said plurality of blocks including connector means for connecting adjacent blocks to one another to assemble said rotating cylindrical screw.

15. A developer transporting device as claimed in claim 14 wherein each of said plurality of blocks is integratedly formed by injection molding.

16. A developer transporting device as claimed in claim 14 wherein said plurality of blocks includes an inflow block and an outflow block having said apertures of said rotating cylindrical screw therein.

17. A developing device comprising:

a housing having a developing opening at a top portion thereof and housing a developing sleeve, a supply roller and a mixing roller, wherein said developing sleeve is adjacent to the developing opening;

said supply roller is below the developing sleeve and supplies developer to said developing sleeve; and said mixing roller is below the supply roller and supplies developer to said supply roller, said mixing roller comprising:

a rotating shaft;

a first transporting member provided on the rotating shaft;

a rotating cylindrical screw concentrically sheathing the rotating shaft and having a second transporting member provided on the exterior surface thereof, said rotating cylindrical screw further having apertures provided at both ends thereof in the circumferential direction for providing communication between said first and second transporting members; and a pair of side walls, said rotating shaft being supported between the pair of walls;

an inflow pipe fixedly mounted on one wall of the pair of walls and extending into one end of the cylindrical screw and provided with a developer inflow opening at a top region facing an aperture of the apertures provided on the cylindrical screw; and an outflow pipe fixedly mounted on the other wall of the pair of walls and extending into the other end of the cylindrical screw and provided with a developer outflow opening at a bottom region facing an aperture of the apertures provided on the cylindrical screw.

18. A developer transporting device for transporting a developer including toner and carrier particles, comprising:

a rotating shaft;

a first transporting member provided on the rotating shaft; and a rotating cylindrical screw concentrically sheathing the rotating shaft and having a second transporting member provided on an exterior surface thereof;

wherein an interior surface of the cylindrical screw has a coefficient of friction that is less than a coefficient of friction of an exterior surface of the cylindrical screw.

19. A developer transporting device as claimed in claim 19 wherein the rotating cylindrical screw has a plurality of apertures provided at both ends in the circumferential direction.

20. A developer transporting device as claimed in claim 19 further comprising:

a pair of side walls, said rotating shaft being supported between the pair of side walls;

an inflow pipe fixedly mounted on one wall of the pair of walls and extending into one end of the cylindrical screw and provided with a developer inflow opening at a top region facing an aperture of the plurality of apertures provided on the cylindrical screw; and an outflow pipe fixedly mounted on the other wall of the pair of walls and extending into the other end of the cylindrical screw and provided with a developer outflow opening at a bottom region facing an aperture of the plurality of apertures provided on the cylindrical screw.

21. A developer transporting device as claimed in claim 18 wherein an interior surface of the cylindrical screw has a ten-point mean roughness which is one-half or less than a mean particle size of the toner particles, and an exterior surface of the cylindrical screw has a ten-point mean roughness which is equal or more than a mean particle size of the carrier particles.

22. A developer transporting device comprising:

a rotating shaft;

a first transporting member provided on the rotating shaft;

a rotating cylindrical screw concentrically sheathing the rotating shaft and having a second transporting member provided on the exterior surface thereof; and a removable cap for covering an end of the cylindrical screw.

23. A developer transporting device as claimed in claim 22 wherein the first transporting member is detachable from the rotating shaft.

24. An electrophotographic image forming apparatus comprising:

a photosensitive member for receiving a plurality of electrostatic latent images thereon;

a plurality of developing devices for developing said plurality of electrostatic latent images, each of said plurality of developing devices including a developer transporting device which includes:

a rotating shaft supported between a pair of walls;

a first transporting member provided on the rotating shaft;

a rotating cylindrical screw concentrically sheathing the rotating shaft and having a second transporting member provided on an exterior surface thereof, the rotating cylindrical screw also having apertures provided at both ends thereof in a circumferential direction;

an inflow pipe fixedly mounted on one wall of the pair of walls and extending into one end of the cylindrical screw and provided with a developer inflow opening at a top region thereof facing an aperture of said apertures of the cylindrical screw;

an outflow pipe fixedly mounted on the other wall of the pair of walls and extending into the other end of the cylindrical screw and provided with a developer outflow opening at a bottom region thereof facing an aperture of said apertures of said cylindrical screw; and means for adjusting the position of said inflow opening and said outflow opening so as to orient the inflow openings of each of said plurality of developing devices to all face a predetermined, uniform direction, and to orient the outflow openings of each of said plurality of developing devices to all face a predetermined, uniform direction.

* * * * *

UNITED STATES PATENT AND TRADEMARK OFFICE

CERTIFICATE OF CORRECTION

PATENT NO. : 5,682,584

DATED : October 28, 1997

INVENTOR(S) : Yoshihiro Hattori, et al.

It is certified that error appears in the above-indentified patent and that said Letters Patent is hereby corrected as shown below:

Column 21, lines 26 and 27, delete "claim 19" and insert --claim 18--.

Signed and Sealed this

Sixteenth Day of June, 1998

*Attest:*

*Attesting Officer*

Bruce Lehman

BRUCE LEHMAN

*Commissioner of Patents and Trademarks*